US008069569B2

(12) United States Patent
Brown et al.

(10) Patent No.: US 8,069,569 B2
(45) Date of Patent: Dec. 6, 2011

(54) UTILITY KNIFE

(75) Inventors: Donald A. Brown, Sterling, MA (US); Kevin Fleury, Feeding Hill, MA (US); William B. Korb, Melrose, CT (US); Norman LeBlane, Harrisburg, NC (US); Steven R. Levine, Mooresville, NC (US); Corey M. Talbel, Hebron, CT (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/895,942

(22) Filed: Aug. 27, 2007

(65) Prior Publication Data

US 2007/0294896 A1 Dec. 27, 2007

Related U.S. Application Data

(62) Division of application No. 10/985,128, filed on Nov. 9, 2004, now abandoned.

(60) Provisional application No. 60/518,689, filed on Nov. 10, 2003, provisional application No. 60/518,690, filed on Nov. 10, 2003.

(51) Int. Cl.
*B26B 5/00* (2006.01)

(52) U.S. Cl. ..... 30/125; 30/331; 30/332; 30/337; 30/339

(58) Field of Classification Search ..... 30/151, 30/162, 329, 335, 339, 330, 331, 125, 332, 30/337

See application file for complete search history.

(56) References Cited

U.S. PATENT DOCUMENTS 2,027,964 A 1/1936 Delbon
2,187,590 A 1/1940 Lurie (Continued)

FOREIGN PATENT DOCUMENTS

GB 2 277 048 * 10/1994

(Continued)

OTHER PUBLICATIONS

Taiwan Preliminary Examination Report for Taiwan Patent App. No. 093134261, dated Apr. 4, 2007.

(Continued)

*Primary Examiner* — Hwei C Payer
(74) *Attorney, Agent, or Firm* — McCarter & English, LLP

(57) ABSTRACT

A handle for a utility knife includes a housing made up of two or more portions. In one embodiment, a manually operable member for use in releasing the blade is retained to at least one portion of the housing and does not become separated from the housing when the housing is in an open state. In another embodiment, a catch for engaging the blade extends from a support member that is slidably movable within the housing. In another embodiment, the housing is formed of metal and a nose portion is formed of a metal that is more wear resistant than the rest of the housing, in order to improve the durability of the nose portion. In another embodiment, a bail screw is captured on a first housing portion and threadedly engageable with a second housing portion for (i) releasably securing the first and second housing portions in a fully closed state and, in turn, releasably securing a blade within the blade opening, and (ii) manually positioning at least one of the first and second housing portions in at least one intermediate state between the fully closed state and a fully opened state to, in turn, permit the blade to be manually moved through the blade opening.

33 Claims, 32 Drawing Sheets

U.S. PATENT DOCUMENTS

| | | | | | |
|---|---|---|---|---|---|
| 2,679,100 | A | | 5/1954 | Ehler | |
| 3,520,059 | A | | 7/1970 | Gringer | |
| 3,577,637 | A | | 5/1971 | Braginetz | |
| 3,660,895 | A | * | 5/1972 | West | 30/162 |
| 4,109,380 | A | * | 8/1978 | Anderson | 30/162 |
| 4,261,104 | A | | 4/1981 | Cuscovitch | |
| 4,408,396 | A | | 10/1983 | Scholl | |
| 4,524,518 | A | | 6/1985 | West | |
| 4,575,940 | A | | 3/1986 | Wenzel | |
| 4,604,805 | A | | 8/1986 | Krieger | |
| 4,662,070 | A | | 5/1987 | Reddig | |
| D290,333 | S | | 6/1987 | Pashley | |
| D296,297 | S | | 6/1988 | Weimann et al. | |
| D296,657 | S | | 7/1988 | LeFeber | |
| 4,862,590 | A | | 9/1989 | Winyard et al. | |
| 4,939,839 | A | | 7/1990 | Gorst | |
| 5,012,581 | A | | 5/1991 | Fletcher et al. | |
| 5,022,156 | A | | 6/1991 | Kallens et al. | |
| 5,122,092 | A | | 6/1992 | Abdul | |
| 5,283,954 | A | | 2/1994 | Szabo | |
| 5,477,755 | A | | 12/1995 | Blakesley et al. | |
| 5,509,205 | A | * | 4/1996 | Ragland, III | 30/162 |
| 5,581,890 | A | * | 12/1996 | Schmidt | 30/162 |
| 5,581,893 | A | | 12/1996 | Ouelette | |
| 5,752,968 | A | | 5/1998 | Jolly et al. | |
| 5,864,954 | A | | 2/1999 | Harrington | |
| 5,940,970 | A | * | 8/1999 | D'Ambro et al. | 30/125 |
| 6,026,575 | A | | 2/2000 | Wonderley | |
| 6,041,505 | A | | 3/2000 | Chen | |
| 6,131,292 | A | | 10/2000 | Reddig | |
| 6,192,589 | B1 | | 2/2001 | Martone et al. | |
| 6,223,439 | B1 | | 5/2001 | Wonderley | |
| 6,249,975 | B1 | | 6/2001 | Lin | |
| 6,324,762 | B1 | | 12/2001 | Huang | |
| 6,438,849 | B1 | | 8/2002 | Wonderley | |
| 6,532,670 | B1 | | 3/2003 | Berns | |
| 6,574,872 | B2 | * | 6/2003 | Roberts et al. | 30/330 |
| 6,675,485 | B1 | * | 1/2004 | Shih et al. | 30/321 |
| 6,845,561 | B2 | * | 1/2005 | Timson | 30/125 |
| 6,971,178 | B2 | * | 12/2005 | Rowlay | 30/162 |
| 7,131,204 | B2 | | 11/2006 | Brown et al. | |
| 7,186,067 | B2 | * | 3/2007 | Leblanc | 411/409 |
| 7,389,587 | B2 | * | 6/2008 | Di Bitonto et al. | 30/162 |
| 7,621,051 | B2 | * | 11/2009 | Ping | 30/162 |
| 7,716,839 | B2 | * | 5/2010 | Onion et al. | 30/157 |
| 2002/0056198 | A1 | | 5/2002 | Ping | |
| 2002/0144407 | A1 | | 10/2002 | Gilbert | |
| 2004/0020057 | A1 | | 2/2004 | Hughes | |
| 2004/0139613 | A1 | * | 7/2004 | Onion et al. | 30/161 |
| 2005/0050734 | A1 | | 3/2005 | Kesinger | |

FOREIGN PATENT DOCUMENTS

| | | |
|---|---|---|
| TW | 289996 | 11/1996 |

OTHER PUBLICATIONS

International Preliminary Report on Patentability for App. No. PCT/US2004/037719, dated Jun. 6, 2005.

Written Opinion of the International Searching Authority for App. No. PCT/US2004/037719, dated Jun. 6, 2005.

International Search Report PCT/USO4/37719 Dated Jun. 6, 2005.

* cited by examiner

UTILITY KNIFE

CROSS-REFERENCE TO RELATED APPLICATIONS

This patent application is a divisional of U.S. patent application Ser. No. 10/985,128, filed Nov. 9, 2004, now abandoned, entitled "UTILITY KNIFE", now abandoned, which claims priority on U.S. Provisional Patent Application Ser. No. 60/518,689, entitled "UTILITY KNIFE", filed on Nov. 10, 2003, and U.S. Provisional Patent Application Ser. No. 60/518,690, entitled "UTILITY KNIFE WITH ACTUATOR FOR MOVING BLADE CARRIER AND FOR RELEASING BLADE THEREFROM, AND RELATED METHOD", filed on Nov. 10, 2003, each of which is hereby expressly incorporated by reference as part of the present disclosure. This patent application also discloses subject matter similar to that disclosed in the following patent applications, each of which also is hereby expressly incorporated by reference as part of the present disclosure: U.S. Design Application Ser. No. 29/193,538, filed on Nov. 10, 2003, now U.S. Pat. No. D 511,447, entitled "UTILITY KNIFE"; U.S. Design Application Ser. No. 29/193,524, filed on Nov. 10, 2003, now U.S. Pat. No. D 511,288, entitled "UTILITY KNIFE"; U.S. Design Application Ser. No. 29/193,586, filed on Nov. 11, 2003, entitled "UTILITY KNIFE"; and U.S. Design Application Ser. No. 29/193,585, filed on Nov. 11, 2003, now U.S. Pat. No. D 508,839, entitled "UTILITY KNIFE".

This patent application is a divisional of U.S. patent application Ser. No. 10/985,128, filed Nov. 9, 2004, entitled "UTILITY KNIFE", co-pending herewith, which claims priority on U.S. Provisional Patent Application Ser. No. 60/518,689, entitled "UTILITY KNIFE", filed on Nov. 10, 2003, and U.S. Provisional Patent Application Ser. No. 60/518,690, entitled "UTILITY KNIFE WITH ACTUATOR FOR MOVING BLADE CARRIER AND FOR RELEASING BLADE THEREFROM, AND RELATED METHOD", filed on Nov. 10, 2003, each of which is hereby expressly incorporated by reference as part of the present disclosure. This patent application also discloses subject matter similar to that disclosed in the following co-pending patent applications, each of which also is hereby expressly incorporated by reference as part of the present disclosure: U.S. Design Application Ser. No. 29/193,538, filed on Nov. 10, 2003, entitled "UTILITY KNIFE"; U.S. Design Application Ser. No. 29/193,524, filed on Nov. 10, 2003, entitled "UTILITY KNIFE"; U.S. Design Application Ser. No. 29/193,586, filed on Nov. 11, 2003, entitled "UTILITY KNIFE"; and U.S. Design Application Ser. No. 29/193,585, filed on Nov. 11, 2003, entitled "UTILITY KNIFE".

FIELD OF THE INVENTION

The present invention relates to utility knives and handles used therein, and to methods for use in association with such knives and handles.

BACKGROUND INFORMATION

Utility knives generally include a handle and at least one replaceable blade. Because such blades are known to become worn or damaged, utility knife handles generally include provisions to allow a blade to be removed from the handle, so that the blade may be reversed in the handle (in order to provide a new cutting edge for the knife) and/or replaced by another blade.

In the case of many utility knives, the removal of a worn or damaged blade requires that the handle first be opened to gain access to the internal cavity inside the handle. However, because it is sometimes inconvenient to open the handle, some utility knives provide mechanisms that allow a blade to be removed without any need for first opening the handle. Such mechanisms often make use of a releasable catch that engages the replaceable blade within the handle along with a manually operable mechanism for causing the releasable catch to disengage from the blade. Most of these mechanisms allow a worn or damaged blade to be removed through a blade opening at the front end of the handle.

Notwithstanding the availability of such mechanisms, there are still occasions in which a handle must be opened, for example, in order to retrieve a spare blade that may be stored inside the handle or to perform repair or maintenance inside the handle. Unfortunately, upon opening the handle, many of the above mentioned mechanism can fall out and become separated from the handle, thereby rendering the mechanism unusable.

Thus, it would be desirable to provide a utility knife handle in which the mechanism for removing the blade is retained to the handle so that the mechanism does not become separated from the handle if opened.

Additional types of releasable catches are also desired.

As with blades, handles can also become worn or damaged due to demanding operating conditions, such as for example in the course of regular use in cutting asphalt roof tiles. Consequently, utility knife handles are sometimes formed of metal (e.g., steel) to provide durability. However, even knives with steel handles continue to become worn and/or damaged frequently, on account of such operating conditions.

Thus, it would be desirable to provide a utility knife handle having improved durability.

SUMMARY OF THE INVENTION

In accordance with some embodiments of the present invention, a utility knife comprises a housing defining an internal cavity and a blade opening at a first end. A catch is disposed in the internal cavity for engaging a blade. The housing includes at least two metal portions, wherein a first one of the metal portions is more wear resistant than a second one of the metal portions In some such embodiments, the first metal portion comprises a nose portion defining the blade opening, and the second metal portion comprises a rear portion disposed to the rear of the nose portion. In one such embodiment, the nose portion and the rear portion are separate components and are fixedly attached to one another. In one such embodiment, one of the nose portion and rear portion defines at least one fastening aperture, and the other of the nose portion and rear portion defines at least one fastening member receivable within the fastening aperture to fixedly attach the nose portion and rear portion to one another. Preferably, an adhesive, such as a cyanoacrylate, is interposed between the nose and rear portions for further securing the nose and rear portions to one another.

In some such embodiments, the first metal portion comprises stainless steel, and the second metal portion comprises at least one of aluminum, zinc, steel, and plastic. In some embodiment of the present invention, the nose portion includes a wear-resistant coating on at least an exterior surface thereof. In one such embodiment, the coated surface extends about a periphery of the blade opening, and is at least one of TiN and AlTiN.

One advantage of a currently preferred embodiment is that the nose portion of the housing can be made of a metal that is more wear resistant than conventional steel, and if desired, coated with TiN and/or AlTiN, to improve the durability at the nose (where needed in such embodiment) at lesser cost than would result from using the more wear resistant material and coating, if desired, throughout the entire housing.

In one embodiment of the present invention, the housing includes two housing portions movable relative to one another. A first positioning of the two housing portions defines a fully open state of the housing allowing access to the internal cavity through an open space between the two housing portions, and a second positioning of the two housing portions defines a fully closed state of the housing preventing access to the internal cavity between the two housing portions. In one such embodiment, the utility knife further comprises a mechanism that releasably secures the two housing portions in the fully closed state, and that positions at least one of the two housing portions relative to the other in at least one intermediate state between the fully closed state and fully open state. In one embodiment of the present invention, the utility knife further comprises a blade received within the blade opening. In the fully closed state, the blade is engaged by the catch and fixedly secured within the blade opening, and in the intermediate state, the blade is manually movable relative to the catch and through the blade opening. In one such embodiment, the mechanism includes a fastener connected to one of the two housing portions, and releasably connectable to the other of the two housing portions. In one such embodiment, the fastener includes a threaded portion, and the other housing portion includes a plurality of threads for threadedly engaging the threaded portion of the fastener in the closed and intermediate states. The utility knife preferably further comprises a biasing member coupled to at least one of the two housing portions that biases at least one of the two housing portions in a direction from the closed state toward the intermediate state.

One advantage of the foregoing embodiments of the present invention is that the same mechanism is employed to both open and close the housing, and to allow a user to manually engage and remove a blade through the blade opening to reinstall the blade and present the other side of the cutting edge for use, to install a new blade, or to simply remove and discard a blade.

In accordance with another disclosed embodiment, a utility knife handle includes a housing having two portions that are movable relative to one another, a first positioning of the two portions defining an open state of the housing, a second positioning of the two portions defining a closed state of the housing in which state the housing defines an internal cavity and a blade opening at a first end. The handle further includes a support member retained to a first one of the two portions and movable between a first position and a second position; a catch connected to the support member, the catch being engageable with a blade when the support member is at a first position and disengaged from any said blade when the support member is at a second position; and a manually operable member in register with an aperture defined by a second one of the two portions and retained to the first one of the two portions by way of the support member, the manually operable member being manually operable to cause the support member to move from the first position to the second position.

One advantage of the above disclosed embodiment is that the manually operable member for use in releasing the blade does not become separated from the housing when the housing is in the open state.

It should be understood that the various aspects of the present invention may be employed individually and/or in any combination thereof.

Other advantages of the above described aspects of the present invention will become apparent in view of the following detailed description of preferred embodiments, claims, and accompanying drawings.

It should be understood, however, that unless otherwise specified, the advantages noted herein are not requirements of the present invention.

DETAILED DESCRIPTION OF THE PREFERRED EMBODIMENTS

Figure 1:
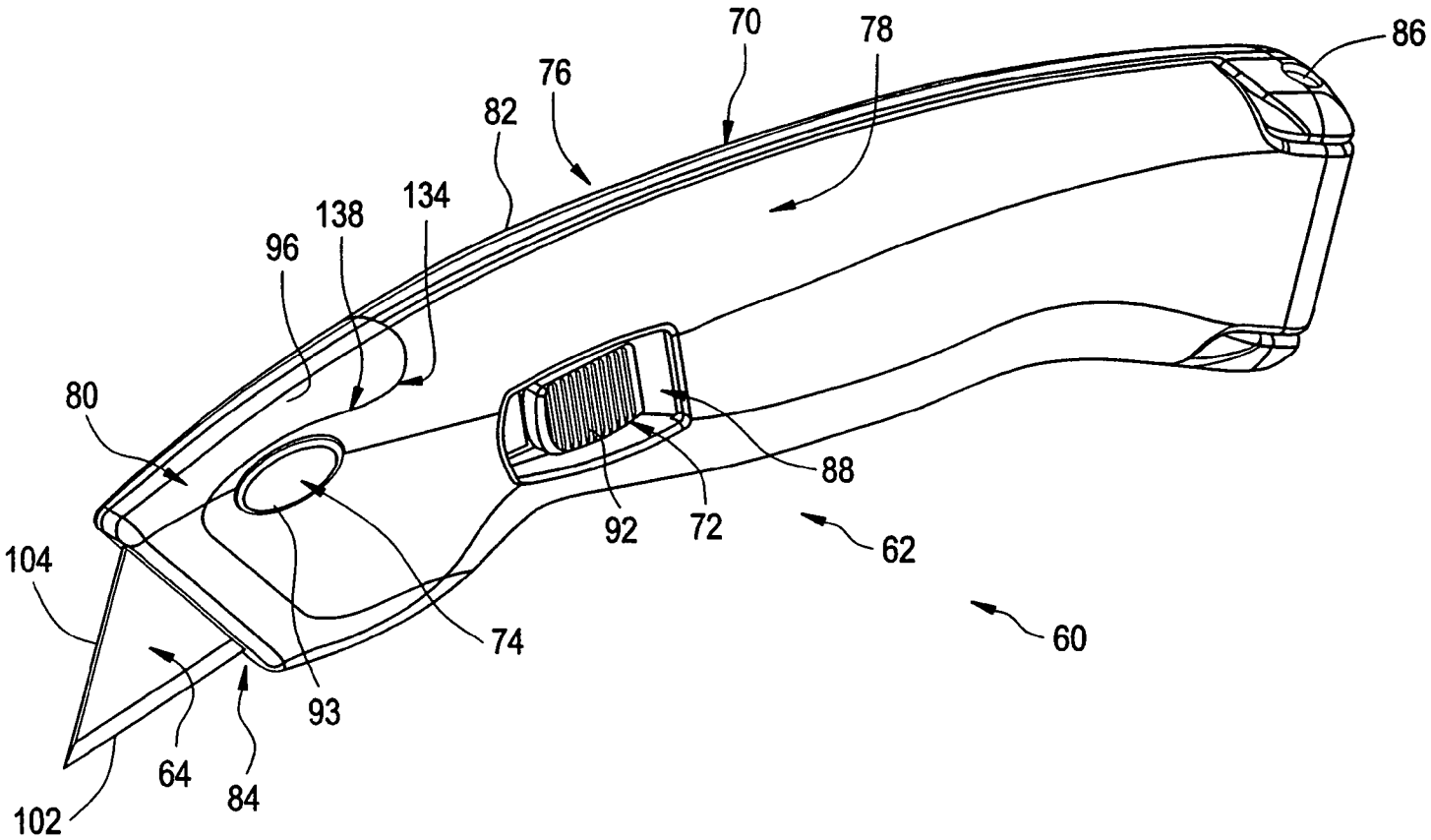
FIG. 1 is a perspective view of a first embodiment of a utility knife.
Figure 2:
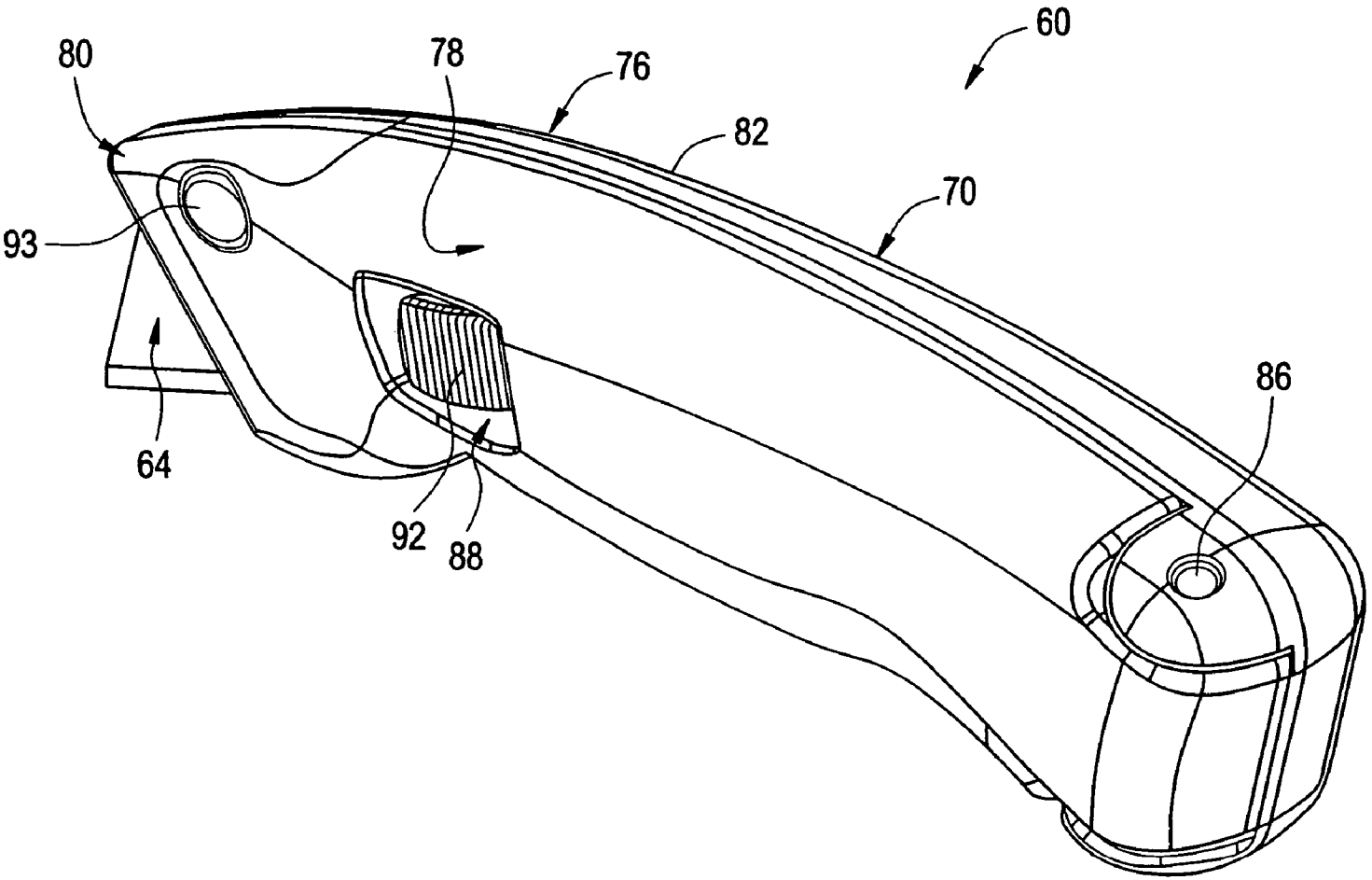
FIG. 2 is another perspective view of the utility knife of FIG. 1.
Figure 3:
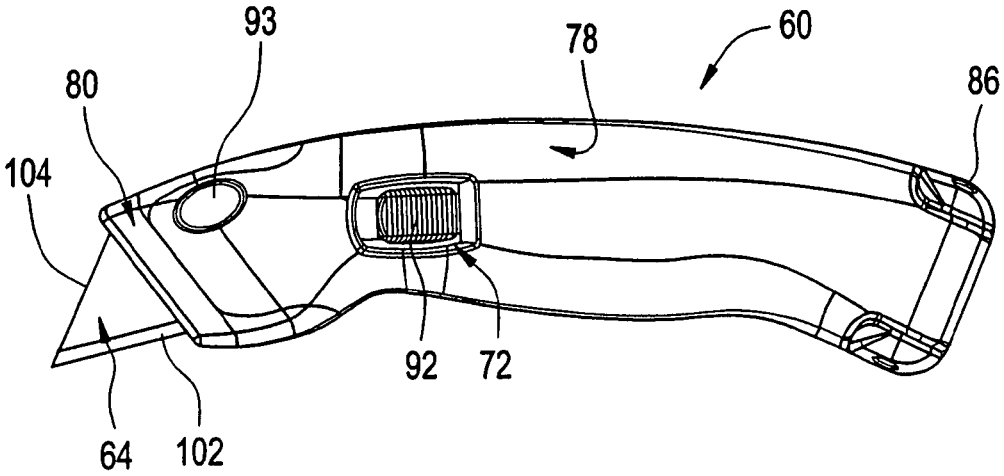
FIG. 3 is a side elevational view of the utility knife of FIG. 1.
Figure 4:
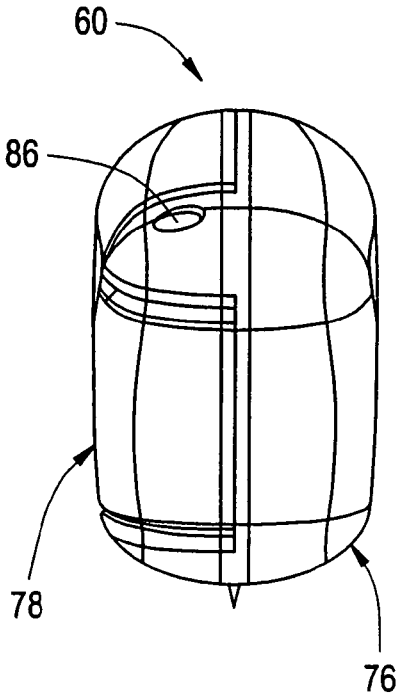
FIG. 4 is a rear elevational view of the utility knife of FIG. 1.
Figure 5:
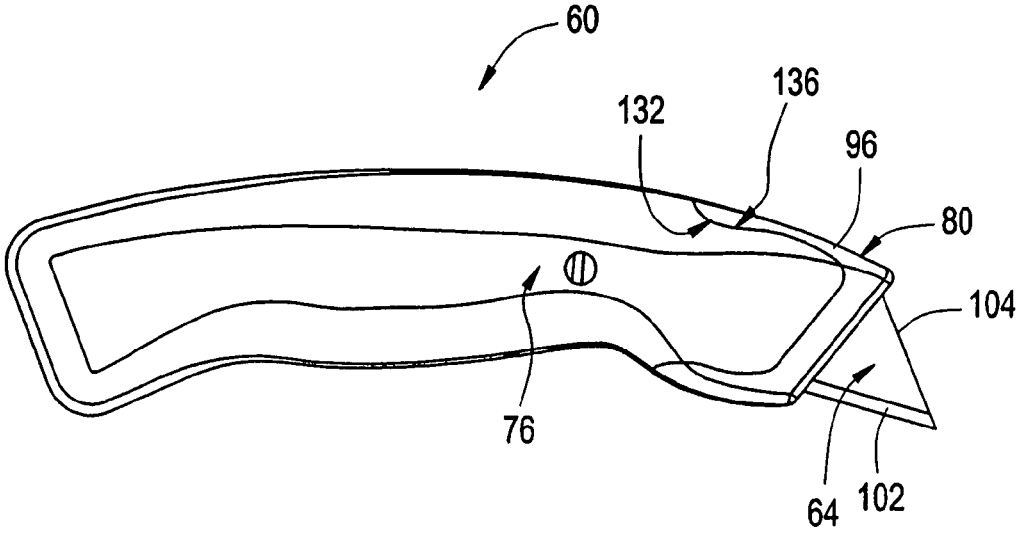
FIG. 5 is another side elevational view of the utility knife of FIG. 1.

FIGS. 1-2 show perspective views of a utility knife 60 according to a first embodiment thereof. The utility knife 60 includes a handle 62, a blade 64 and a spare blade assembly 66 (see FIG. 8) for storing spare blades 68 (see FIG. 8). The handle 62 includes a housing 70 (shown in a closed state) defining a substantially internal cavity 71 (FIG. 8), a mechanism 72 for releasably holding the two portions of the housing together (see also FIG. 8) and a mechanism 74 for releasably engaging the blade 64 (see also FIG. 8).

The housing 70 is formed of two separate portions 76, 78. The first portion 76 is made up of a nose portion 80 and a rear portion 82 disposed rearward of the nose portion 80 (see also FIG. 8). The nose portion 80 defines a blade opening 84 at a first end of the handle 62 to receive the blade 64. The rear portion 82 is, to some extent, a mirror image of the second housing portion 78 and pivotably connected thereto, for example by a fastener (e.g., shown as a pin 86) disposed toward a rear end of the housing 70.

Figure 8:
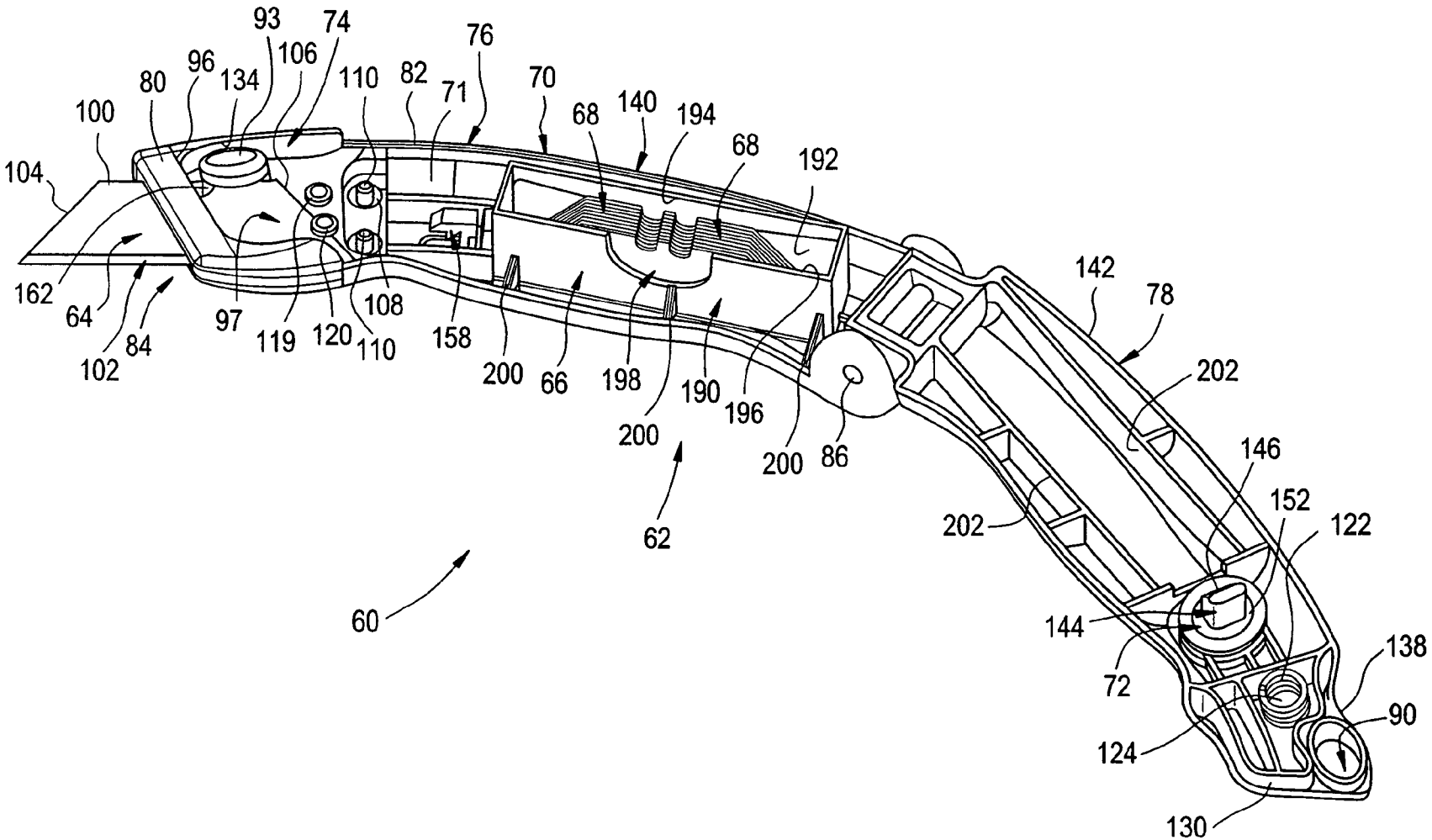
FIG. 8 is a perspective view of the utility knife of FIG. 1 with the housing in an open state.
Figure 9:
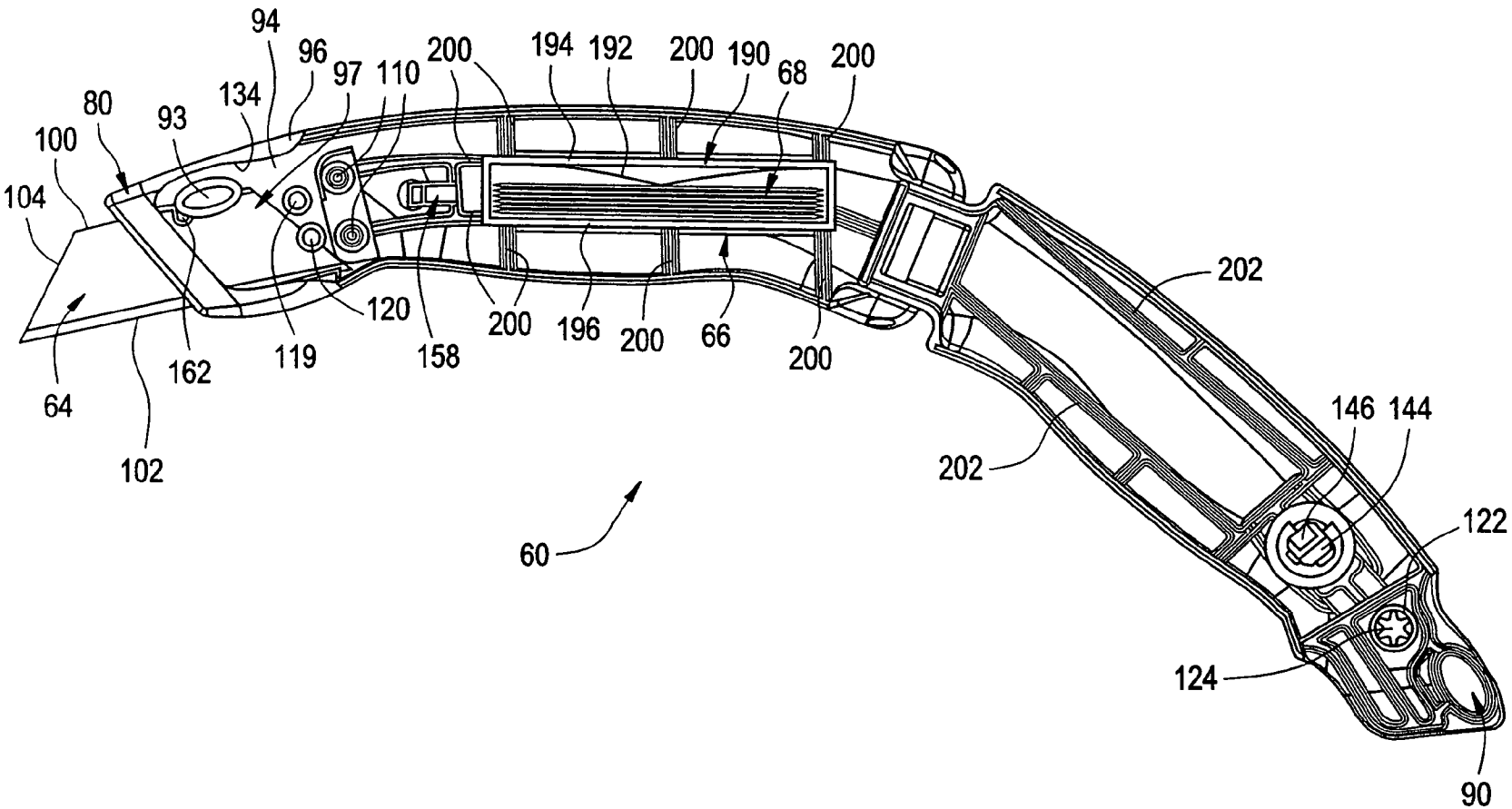
FIG. 9 is side elevational view of the utility knife of FIG. 1 with the housing in the open state.
Figure 10:
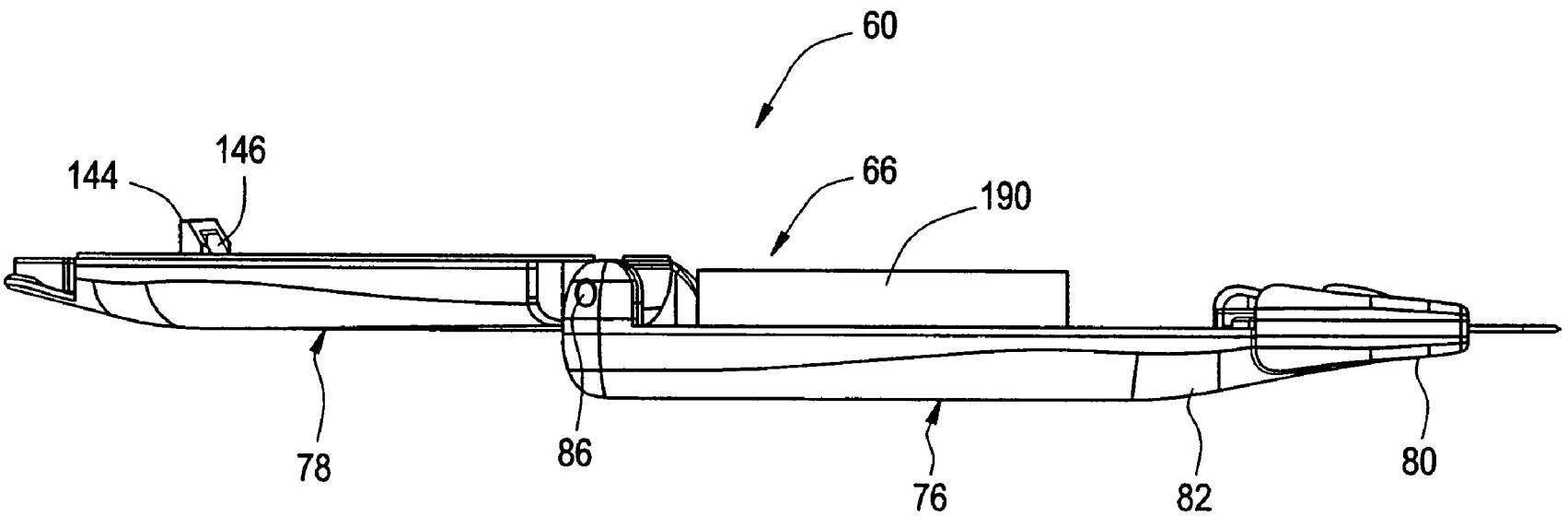
FIG. 10 is top elevational view of the utility knife of FIG. 1 with the housing in the open state.

The second housing portion 78 defines two openings or recesses 88, 90. As shown in FIGS. 1 and 2, the first opening or recess 88 receives a manually operable button portion 92 of the mechanism 72 for releasably fastening the two portions 76, 78 of the housing 70. As shown in FIG. 8, the second opening or recess 90 receives a manually operable button portion 93 of the mechanism for releasably engaging the blade 64.

In this particular embodiment, the nose and rear portions 80, 82 are formed separately and thereafter fixedly attached to one another, for example, but not limited to, by fastening, welding, bonding, forcing, or gluing the two portions together. It should be understood that the nose and rear portions 80, 82 also may be formed in an integral fashion, for example, as a single piece, or still further, in a build-up fashion, for example, by over molding, where one portion is formed and concurrently joined to another portion which was previously formed.

The housing portions 76, 78, 80 may be formed in any manner, for example, but not limited to, by casting (e.g., investment casting), metal injection molding, machining, welding, and/or combinations thereof, and of any suitable material, for example, but not limited to, metal, carbon fiber, plastic, rubber, and/or combinations thereof. Some embodiments may employ powdered metal. Moreover, there is no requirement that the portions 76, 78, 80 be made of the same material. For example, if the portions 76, 78, 80 are formed of metal, they may or may not be formed of the same metal.

Indeed, in some embodiments, the nose portion 80 is formed of a metal (e.g., conventional or stainless steel) that is more wear resistant than the metal(s) forming the second housing portion 78 and the rear portion 82 of the first housing portion 76 (e.g., aluminum or conventional steel, respectively), in order to increase the durability of the nose This has the advantage that selected portion(s) of the housing can be made more wear resistant than other portions, to improve the durability where needed, without the need to make the entire housing more wear resistant. Because higher wear resistant materials are often more expensive than less wear resistant materials, this approach provides an opportunity to improve durability, where needed, at lesser cost than would result from using higher wear resistant materials throughout the entire housing.

Note that in some embodiments, the nose portion is formed of conventional or stainless steel using metal injection molding, powdered metal or investment casting, and the rest of the housing is formed of a zinc or aluminum die casting, an injection molding of plastic or a combination thereof. Elastomeric materials, e.g., rubber, also may be employed, e.g., as inserts to aid in gripping of the knife.

Figure 13:
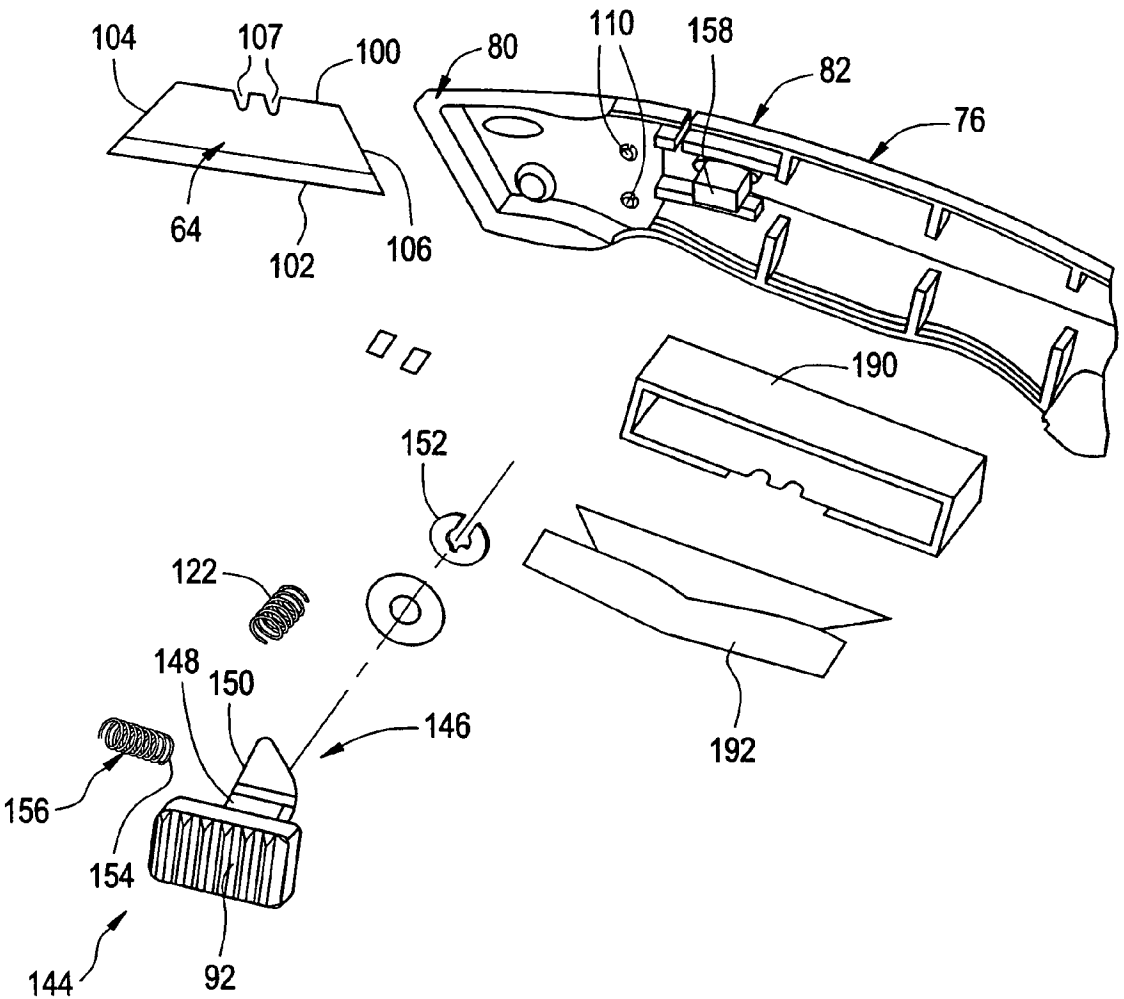
FIG. 13 is another perspective view of a portion of the utility knife of FIG. 1 in a partially disassembled condition and the second housing portion omitted.
Figure 17:
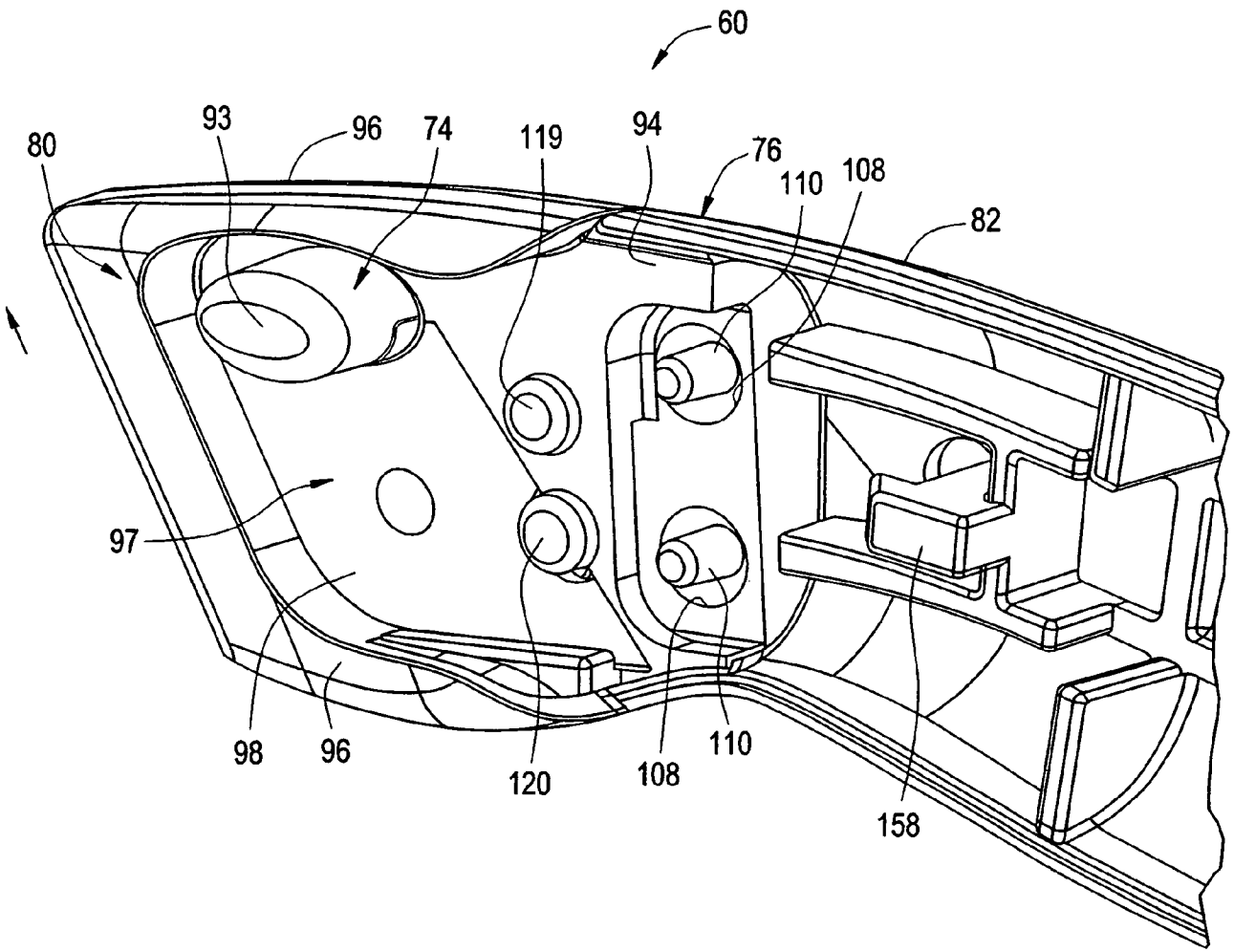
FIG. 17 is a perspective view of a portion of the first housing portion and the mechanism for releasably engaging the blade

FIG. 8 shows a perspective view of the utility knife 60 with the housing 70 in an open state. Referring now to FIG. 8, the nose portion 80 of the housing 70 includes a support portion 94 and a generally U shaped outer portion 96 extending therefrom. The support portion 94 defines a recess 97 with a blade support surface 98 (FIG. 17) for seating the blade 64. The depth of the recess 97 is approximately equal to the thickness of the blade 64, although in some embodiments, the depth may be chosen to be slightly smaller or slightly larger than the thickness of the blade 64. The blade support surface 98 has a shape that generally corresponds to the shape of the blade portion to be seated therein. In this embodiment, the blade 64 has a generally trapezoidal shape that defines a back edge 100, a cutting edge 102, and two side edges 104, 106 located on opposite sides between the back and cutting edges 100, 102. The blade 64 further defines one or more notches 107 (FIG. 13) that are formed in the back edge and laterally spaced relative to one another. Each notch 107 may define, for example, a concave, approximately semi-circular profile, although other shapes may also be employed. As will be further described below, one or more of the notches 107 are engaged within the knife 60 to releasably retain the blade within the knife 60.

Figure 14A:
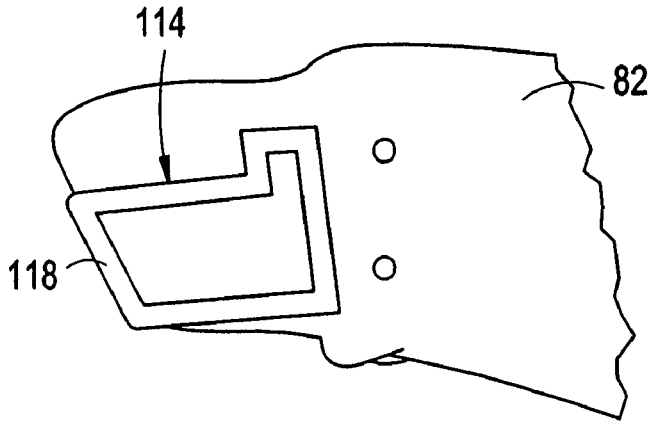
FIGS. 14A-14C are elevational views of the nose and rear portions of the first housing portion in a disassembled state.
Figure 14B:
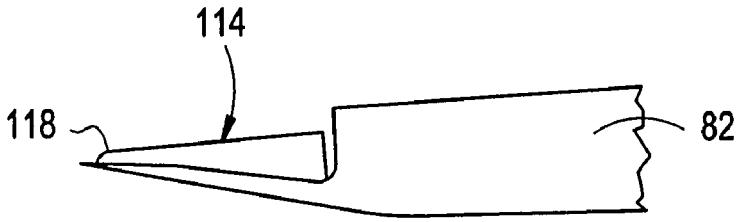
Figure 14C:
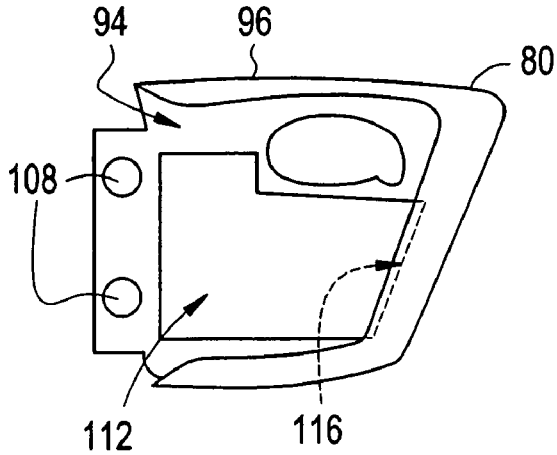
Figure 15:
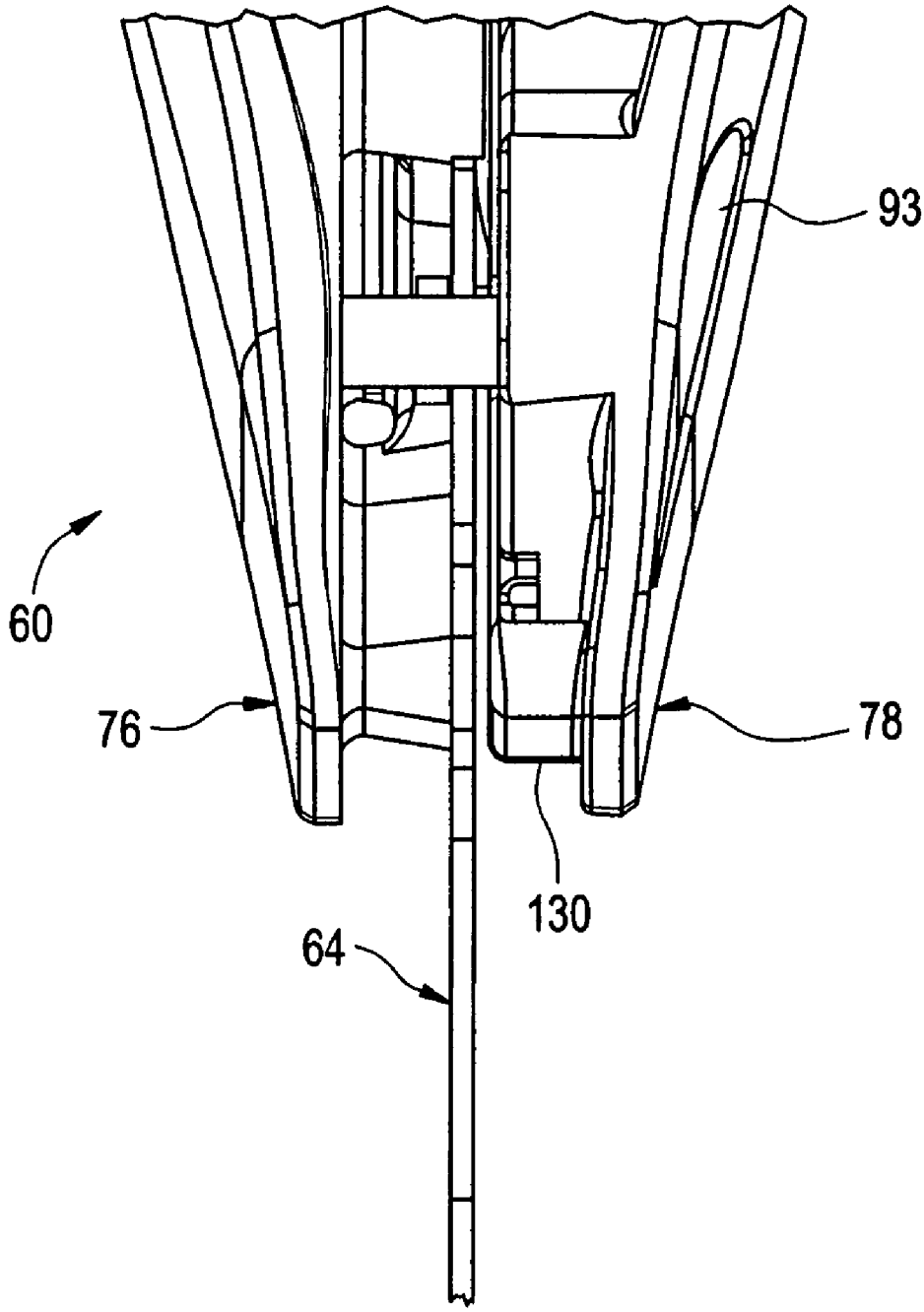
FIG. 15 is a top elevational view showing a front portion of the utility knife of FIG. 1 with the nose portion omitted.

The support portion 94 further defines two spaced apart apertures 108 that are engaged by correspondingly spaced and shaped bosses 110 extending laterally from the rear portion 82 to retain the nose portion 80 and the rear portion 82 together. During assembly of the utility knife 60 the ends of the bosses 110 are peened or otherwise laterally deformed to engage the edges of the corresponding apertures 108 and, in turn, fixedly secure the nose portion 80 to the rear portion 82. In one embodiment of the utility knife, an adhesive is applied to the interface of the nose portion 80 and rear portion 82 to further secure the nose portion to the rear portion. One such adhesive is cyanoacrylate; however, as may be recognized by those or ordinary skill in the pertinent art based on the teachings herein, numerous other adhesives or like bonding mechanisms that are currently known, or that later become known, equally may be used. The support portion 94 may also define one or more recesses 112 (FIG. 14C) that engage one or more corresponding catches 114 (FIGS. 14A-14B) defined by the rear portion 82 to help stiffen the connection therebetween. Such recesses 112 may include a recess 116 (FIG. 14C) that extends in a direction substantially parallel to the major surface of the blade 64 and is engaged by a corresponding shaped and oriented flange 118 (FIGS. 14A-14B) extending from the rear portion 82 for stiffening the connection between the nose portion 80 and the rear portion 82. The recess 112 and catch 114 may have a generally L-shaped profile, as shown, however this is not required.

The support portion 94 further defines a boss 119 and a flange 120. The boss 119 projects laterally from the support portion 94 and functions as a guide and a seat for a laterally extending spring 122 retained on the second housing portion 78 by a laterally extending catch 124. The spring 122 helps reduce relative movement between the two housing portions 76, 78 when the housing is in a closed state. The flange 120 extends substantially parallel to the major surface of the blade 64 to help trap the blade 64 in the seat described above.

Figure 6:
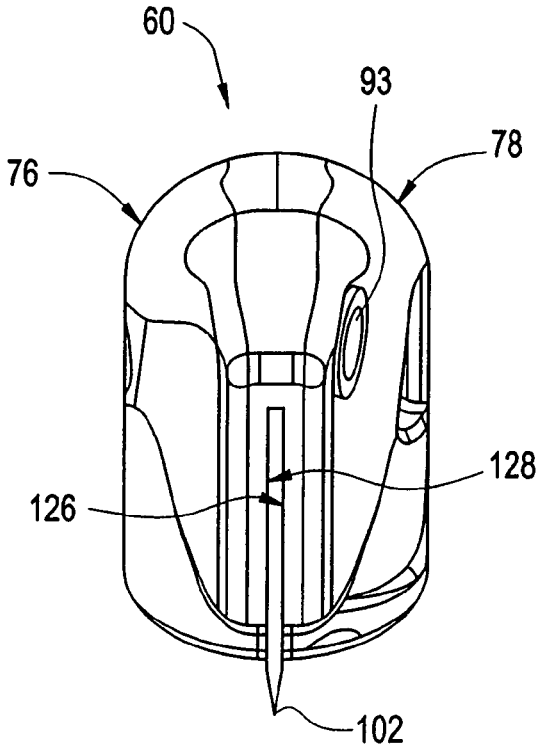
FIG. 6 is a front elevational view of the utility knife of FIG. 1.

The U-shaped outer portion 96 has spaced apart opposing surfaces 126, 128 (FIG. 6) that define the blade opening 84. The opposing surfaces 126, 128 may be substantially planar and substantially parallel to one another, although this is not required. The two surfaces 126, 128 are separated by a distance that is selected, for example, to be large enough to allow the blade 64 to pass there between yet small enough that the surfaces 126, 128 provide some lateral stability for the blade 64 during use, e.g., during cutting, sticking, etc. Note that the second housing portion 78 defines a serpentine rib 130 (FIG. 8) that extends laterally from the second housing portion 78 to provide further lateral stability during use. The rib 130 is disposed in a position that is generally in register with the blade support surface of the recess 97 while the handle is in the closed state.

Figure 7:
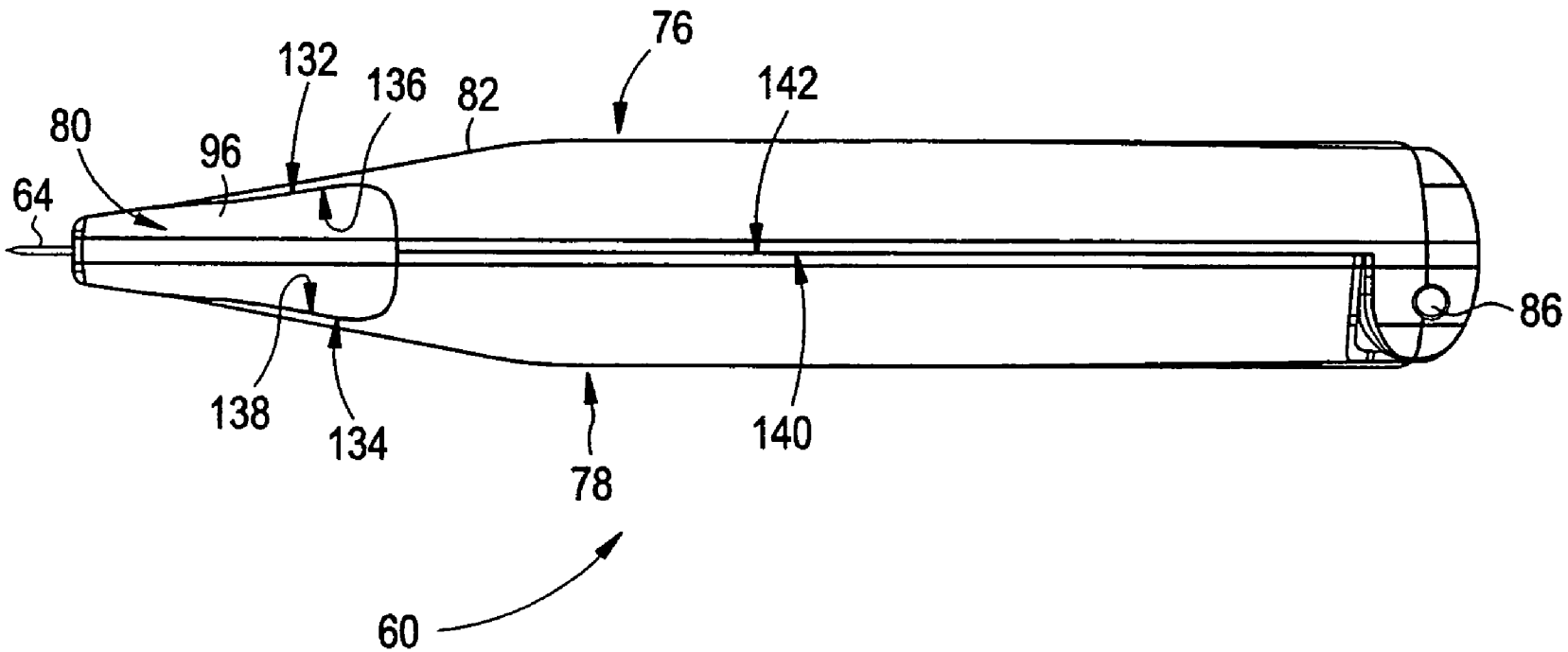
FIG. 7. is a top elevational view of the utility knife of FIG. 1.

As shown typically in FIG. 7, the U-shaped outer portion 96 defines two mating surfaces 132, 134. A first one of these mating surfaces 132 is substantially complementary to a first mating surface 136 of the rear portion 82 of the first housing portion 76. A second one of these mating surfaces 134 is substantially complementary to a first mating surface 138 of the second housing portion 78. Note that a second mating surface 140 of the rear housing portion 82 is substantially complementary to a second mating surface 142 of the second housing portion 78.

Figure 11:
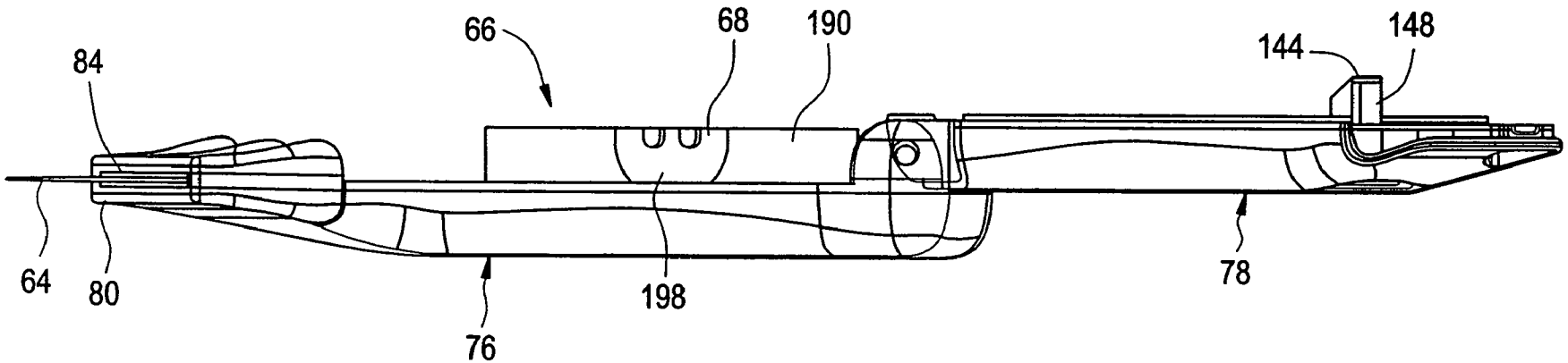
FIG. 11 is bottom elevational view of the utility knife of FIG. 1 with the housing in the open state.
Figure 12:
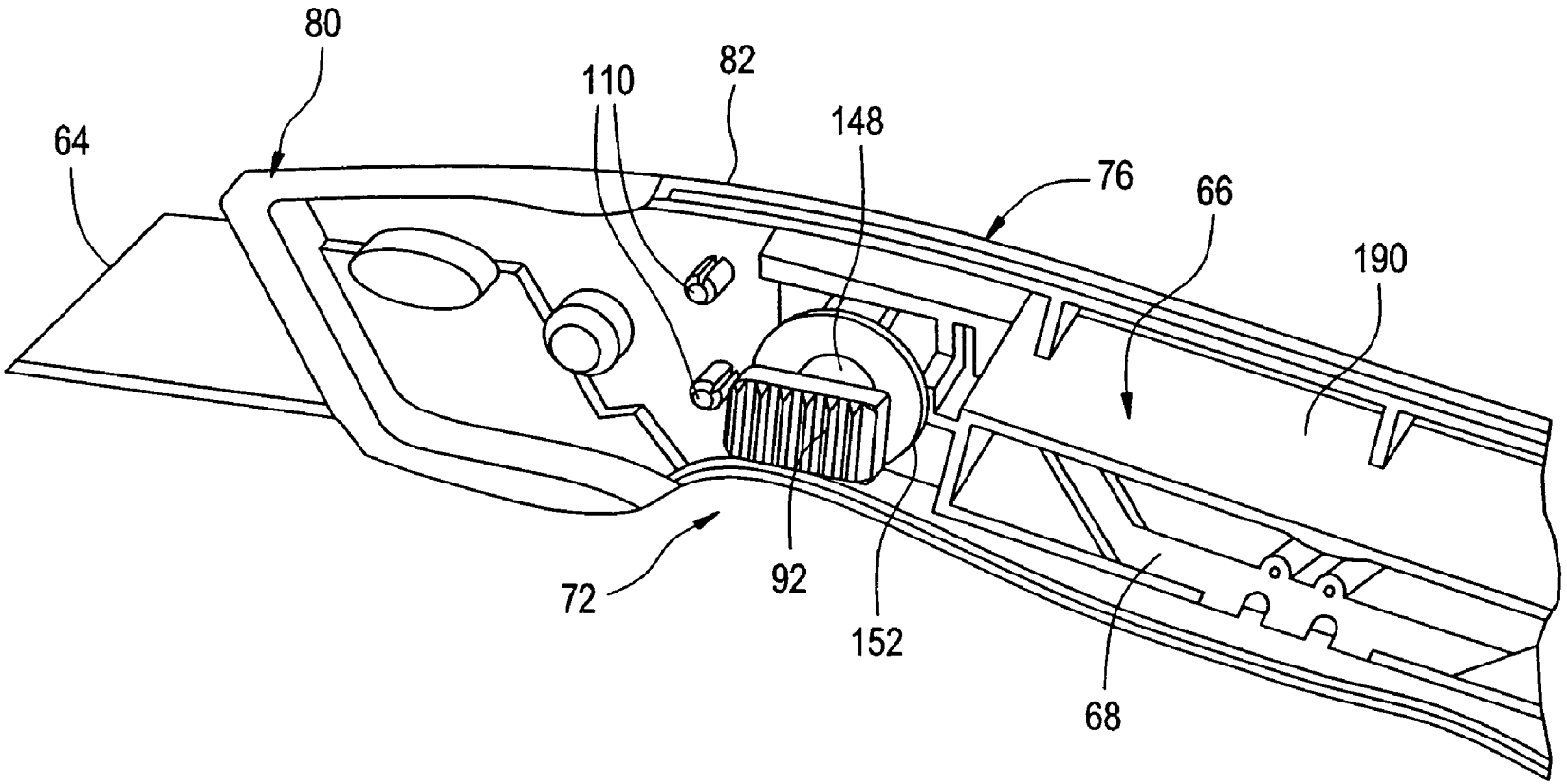
FIG. 12 is a perspective view of a portion of the utility knife of FIG. 1 with the second housing portion omitted.

The mechanism 72 for releasably fastening the two portions 76, 78 of the housing includes a first slidable member 144 that defines the manually operable button 92 and a catch 146 joined thereto, for example, by way of a lateral projection 148 (FIGS. 11-12). The lateral projection 148 defines a slot 150 (FIG. 13) that receives a clip 152 to retain the slidable member 144 to the second housing portion 78. The projection 148 may also define a recess (not shown) that captures an end 154 of a spring 156 to retain the spring 156 to the second housing portion 78. The mechanism 72 further includes a latch 158 that projects from the first housing portion 76. The latch 158 defines a shape that is substantially complementary to the shape defined by the catch 146.

The operation of the mechanism 72 is as follows. The spring 156 biases the slidable member 144 toward an engagement position (e.g., toward the rear of the housing) wherein the catch 146 engages the complementary latch 158 to fasten the two portions 76, 78 of the housing together and thereby place the housing in the closed state. The button 92 is manually slidable toward a disengagement position (e.g., toward the front of the housing), wherein the catch 146 is disengaged from the latch 158 so that the front ends of the two housing portions 76, 78 may be moved apart from one another to place the housing in an open state. The spring 122 (FIG. 8) mounted on the second housing portion 78 helps separate the two housing portions 76, 78 upon disengagement.

Figure 18:
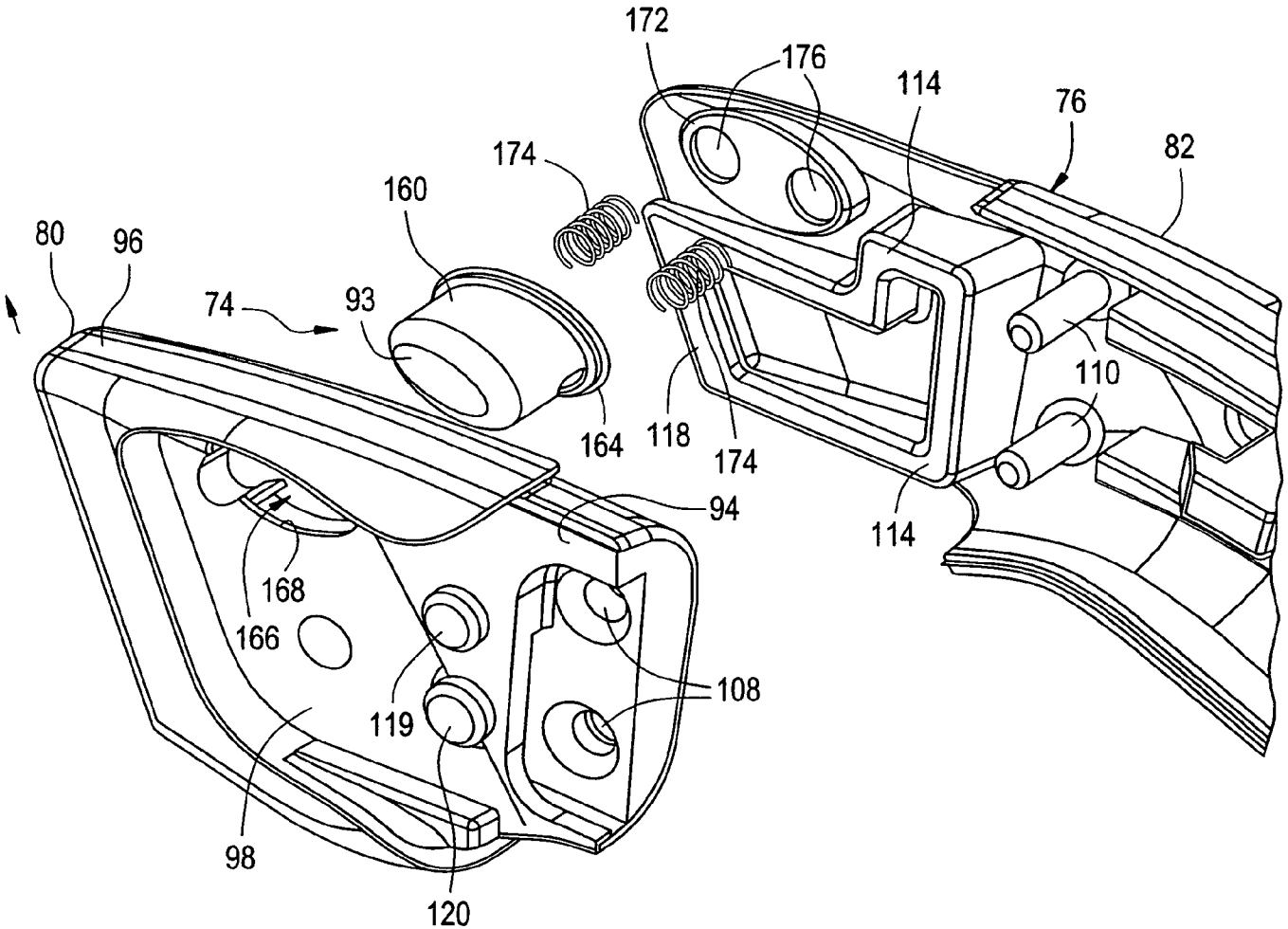
FIG. 18 is a perspective view of a portion of the first housing portion and the mechanism for releasably engaging the blade, shown in a disassembled state.
Figure 19:
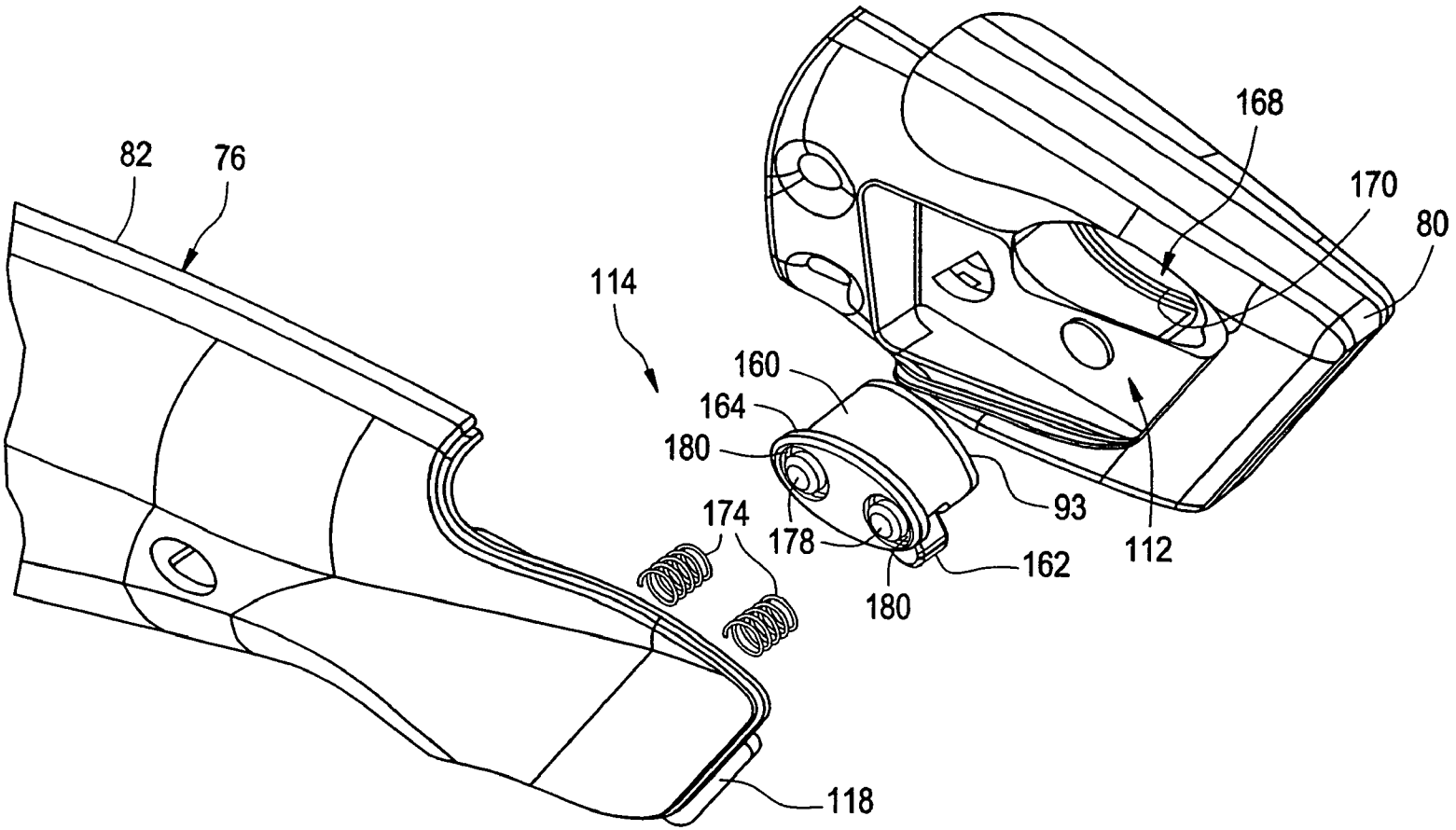
FIG. 19 is another perspective view of a portion of the first housing portion and the mechanism for releasably engaging the blade, shown in a disassembled state.
Figure 20:
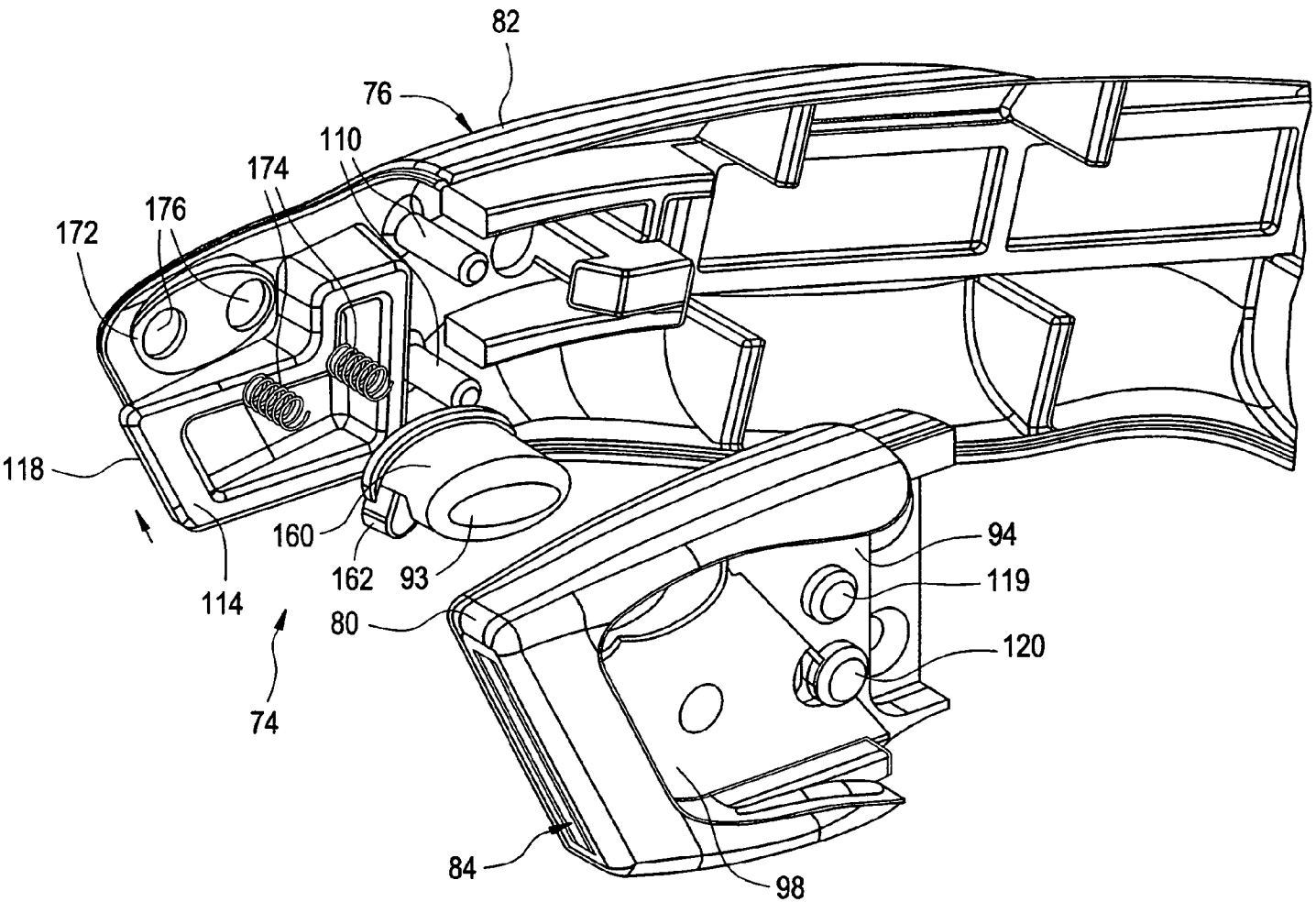
FIG. 20 is another perspective view of a portion of the first housing portion and the mechanism for releasably engaging the blade, shown in a disassembled state.
Figure 21:
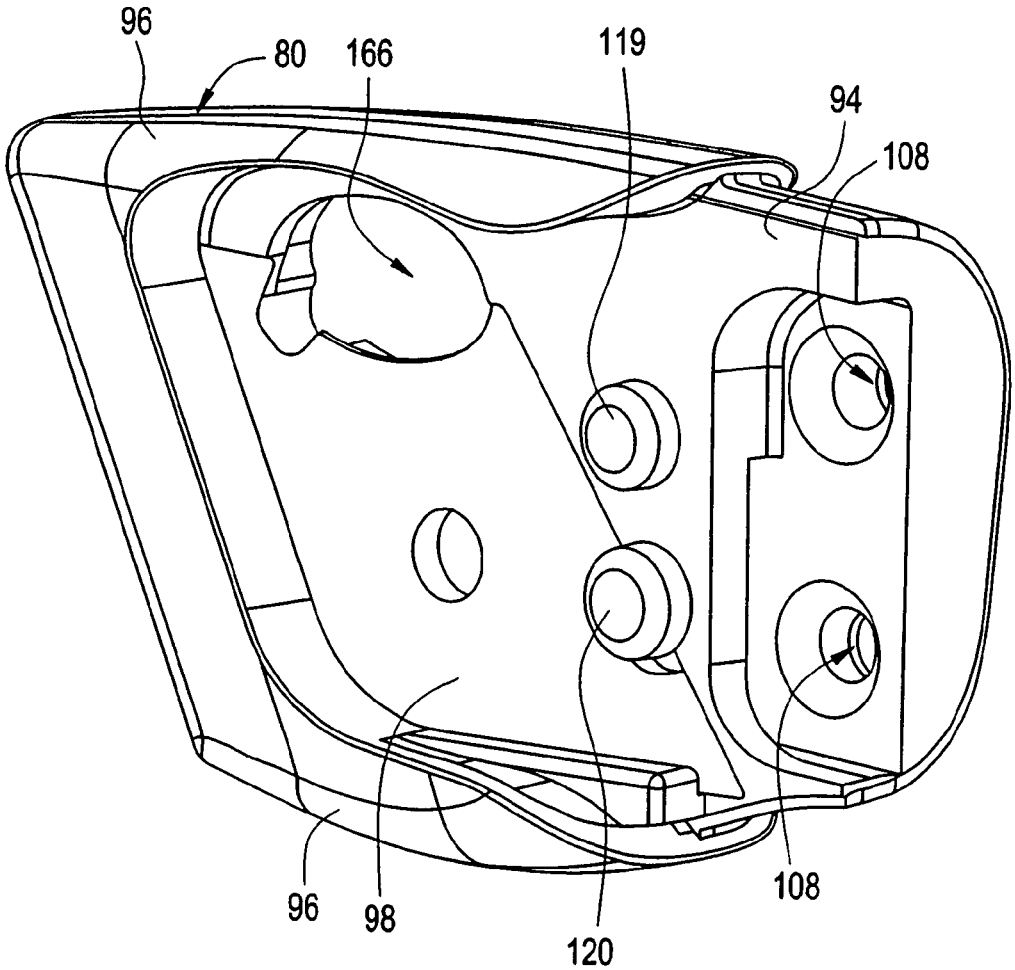
FIG. 21 is a perspective view of the nose portion.
Figure 22:
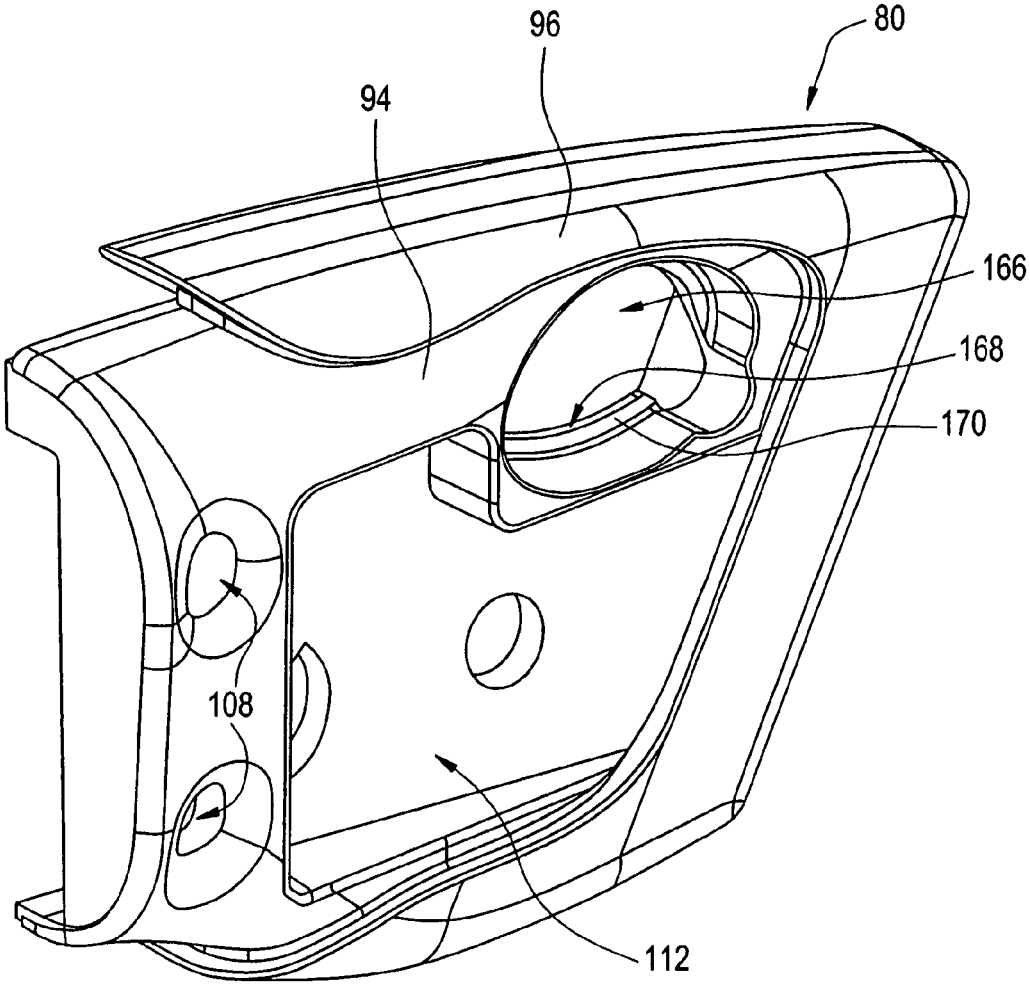
FIG. 22 is another perspective view of the nose portion.
Figure 23:
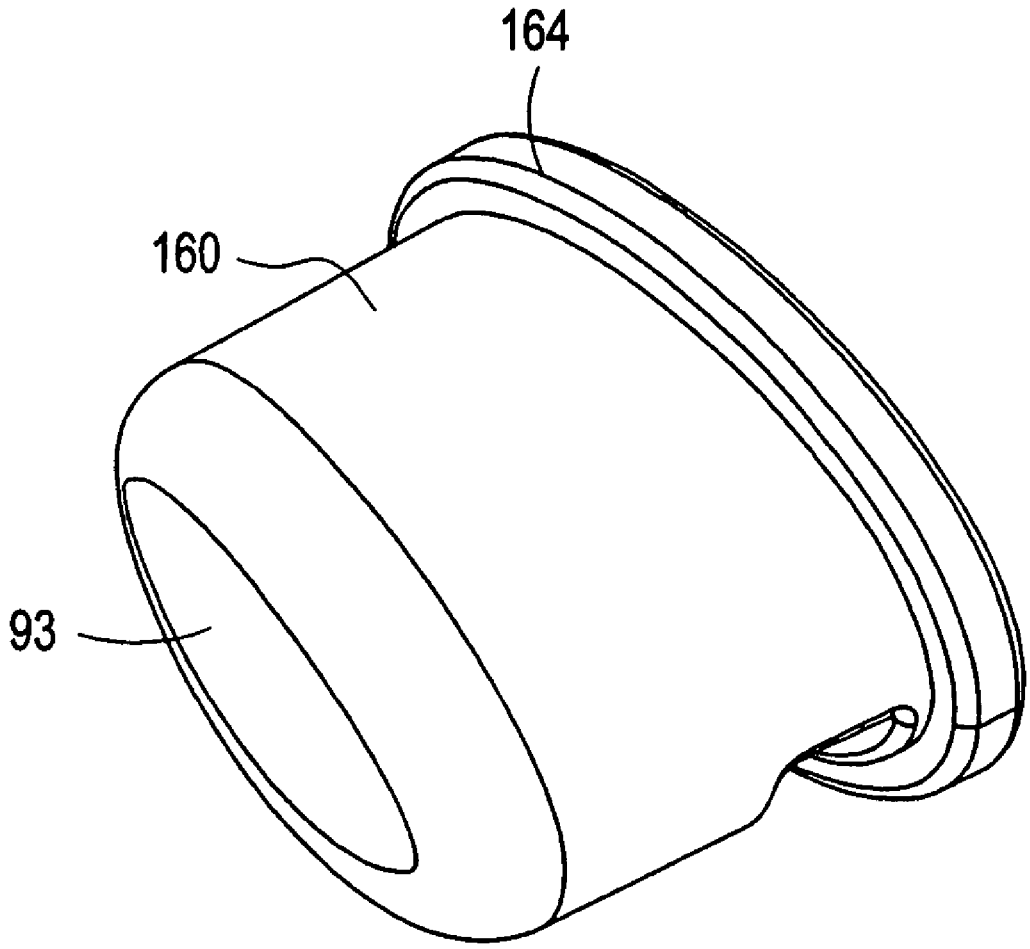
FIG. 23 is a perspective view of the mechanism for releasably engaging the blade.
Figure 24:
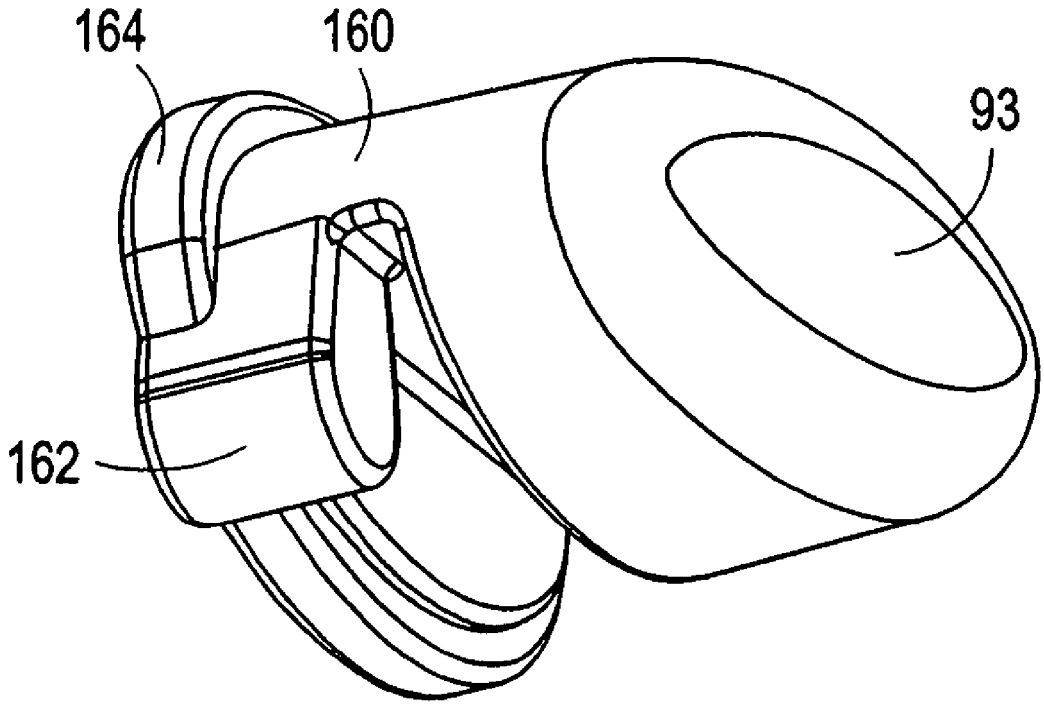
FIG. 24 is another perspective view of the mechanism for releasably engaging the blade.
Figure 25:
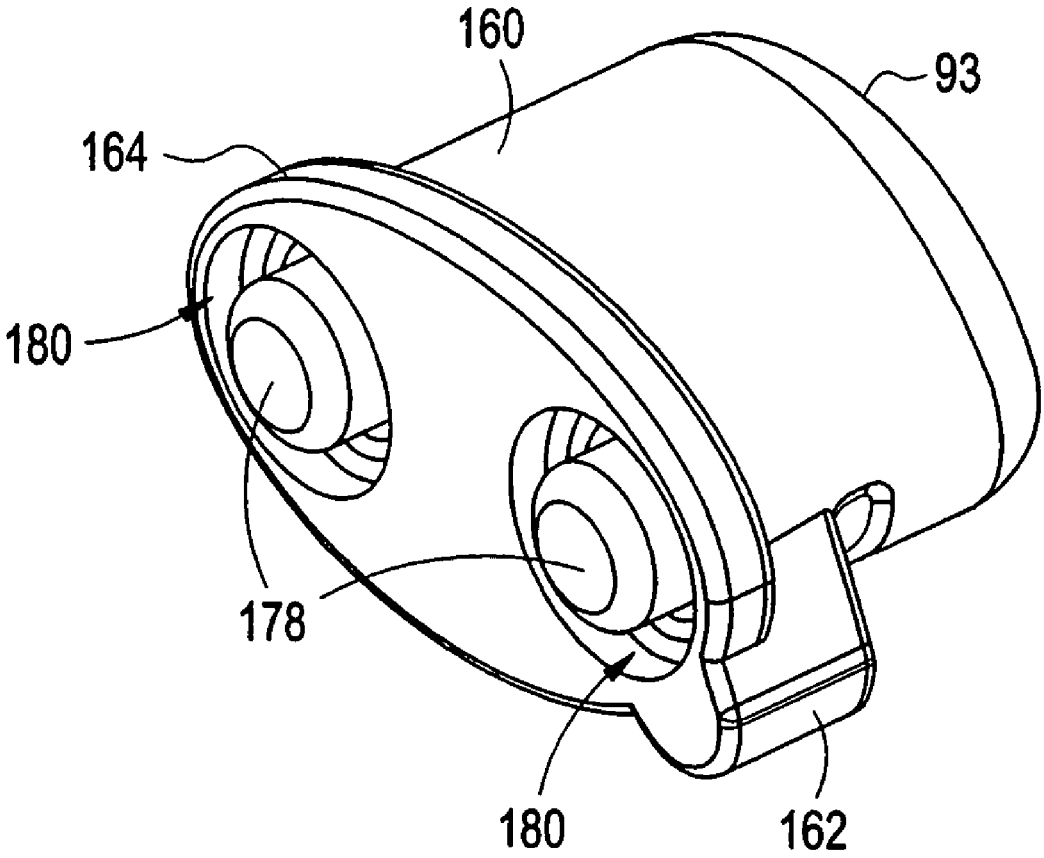
FIG. 25 is another perspective view of the mechanism for releasably engaging the blade.
Figure 26:
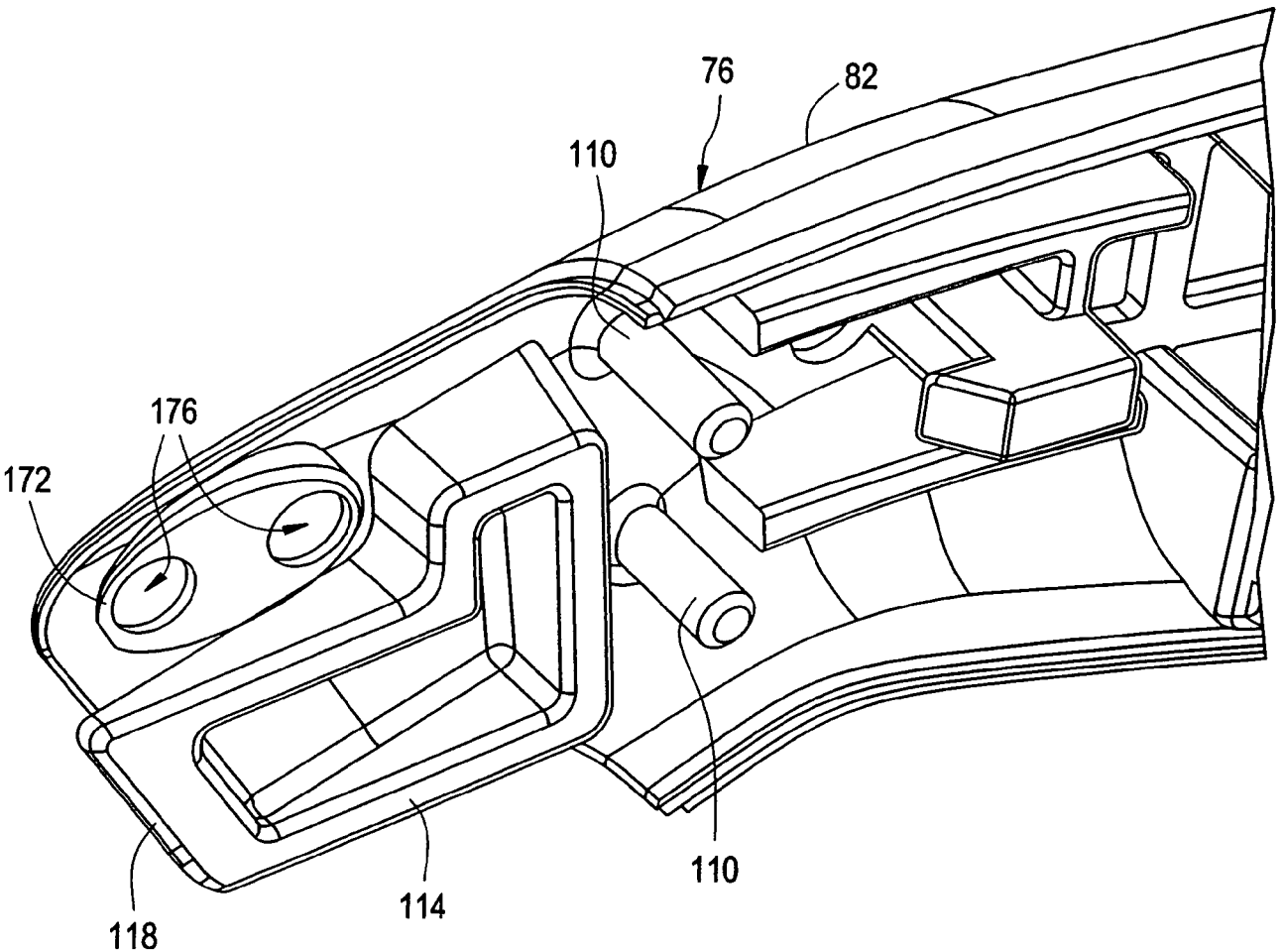
FIG. 26 is a perspective view of the rear portion of the first housing portion.
Figure 27:
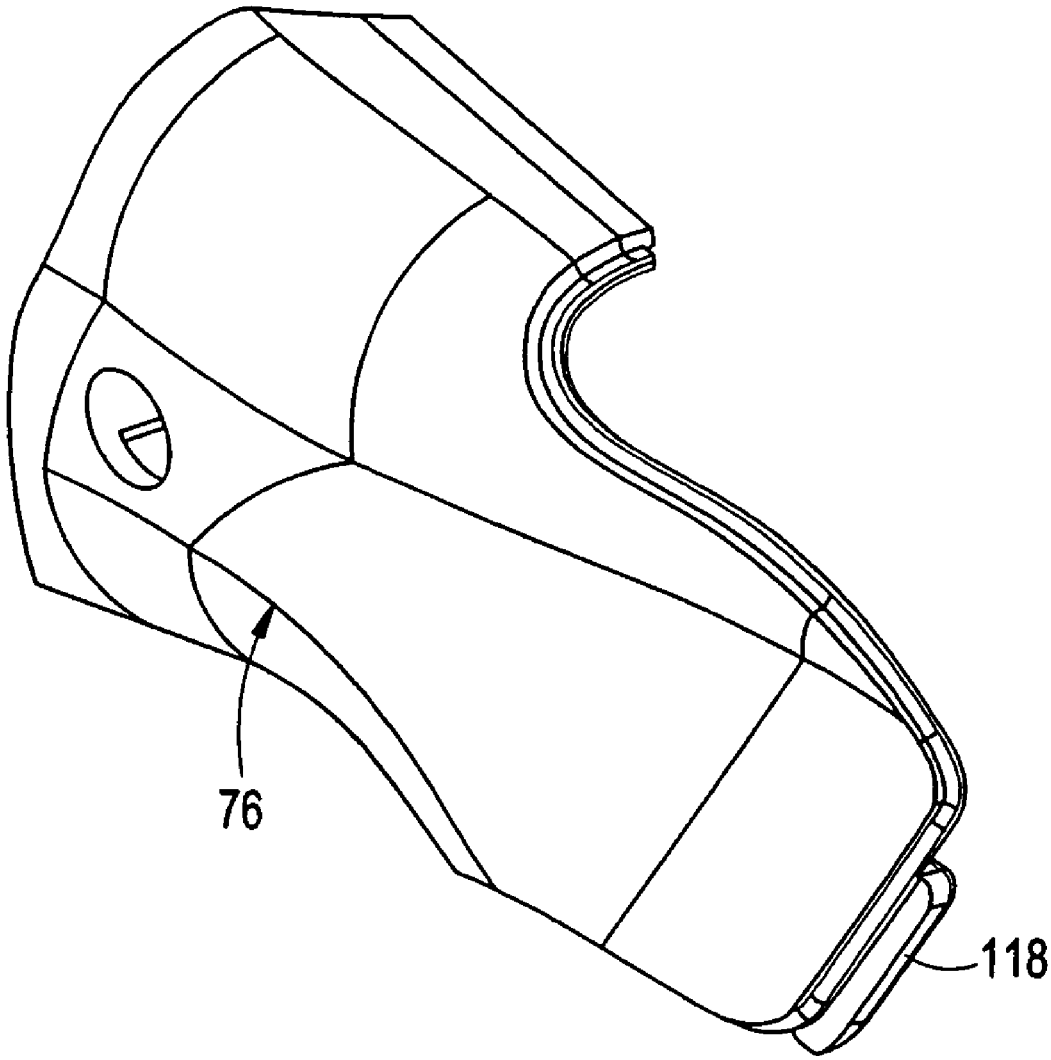
FIG. 27 is another perspective view of the rear portion of the first housing portion.

As shown typically in FIGS. 18-20, the mechanism 74 for releasably engaging the stationary blade 64 includes a support member 160, a catch 162 and the manually operable button 93. The catch 162 extends from the support member 160 and defines a shape that is approximately complementary to the shape of the notch(es) in the blade 64. The manually operable button 93 extends transversely from the support member 160, and, with the housing in the closed state, is generally in register with the opening 90 so that the button 93 is received by such opening, and/or manually operable therethrough. The support member 160, the catch 162 and the manually operable button 93 may be integrally formed into a single component with a generally oval profile, as shown, although this is not required.

In this embodiment, the mechanism 74 for releasably engaging the stationary blade 64 is captured to the first housing portion 76, for example, as shown in FIGS. 18-20, such that the mechanism 74 does not become separated from the housing in the event that the housing is in the open state. As shown in FIGS. 18-20, the support member 160 defines a flange 164 that extends circumferentially about the support member 160 and parallel to the blade support surface 98. The first housing portion 76 defines an opening 166 and a flange 168, for example, adjacent to the blade support surface 98. The opening 166 has a shape that is selected, for example, large enough to allow the catch 162 and the manually operable button 93 to pass therethrough yet small enough to prevent the flange 164 from passing therethrough, thereby capturing the mechanism to the first housing portion. As shown in FIG. 19, the flange 168 defines a first support surface 170 for seating the flange 164 when the support portion 160 is at a first lateral position. As shown in FIG. 18, the first housing portion 76 further defines a second support surface 172 for seating the flange 164 when the support portion 160 is at a second lateral position. Each of the support surfaces 170, 172 has a shape that generally corresponds to the shape of the respective portion of the flange 164 to be seated thereon.

Two biasing members 174 are shown disposed between the first housing portion 76 and the support member 160. In this regard, the first housing portion 76 defines two recesses 176 (FIG. 18) each of which defines a seat for capturing a first end of a respective one of the biasing members 174. The support member 160 defines two bosses 178 and two recesses 180 disposed circumferentially thereabout (FIG. 19). Each of the two recesses 180 defines a seat for a second end of a respective one of the biasing members 174. The bosses help guide and retain each of the biasing members 174 in the respective recess 180. It should be understood that although the biasing members 174 are shown as springs (or spring-like members)

having one end that abuts the housing and another end that abuts the support member, any type of biasing member may be used.

The operation of the mechanism 74 is as follows. The biasing member(s) 174 bias the catch 162 toward a blade engaging position (e.g., toward the second housing portion 78) wherein the catch 162 engages one or more notches 107 of the blade 64 to retain the blade 64 in the handle. Manually depressing the button 93 forces the catch 162 out of its blade engaging position (e.g., toward the first housing portion) wherein the blade 64 may be removed through the blade opening 84, and reversed, or a new blade inserted.

One advantage of the above described mechanism is the provision of a new type of biased catch. Another advantage of the above mechanism is that that the manually operable member is retained to the first portion of the housing and therefore does not become separated from the housing when the housing is in the open state.

Figure 16:
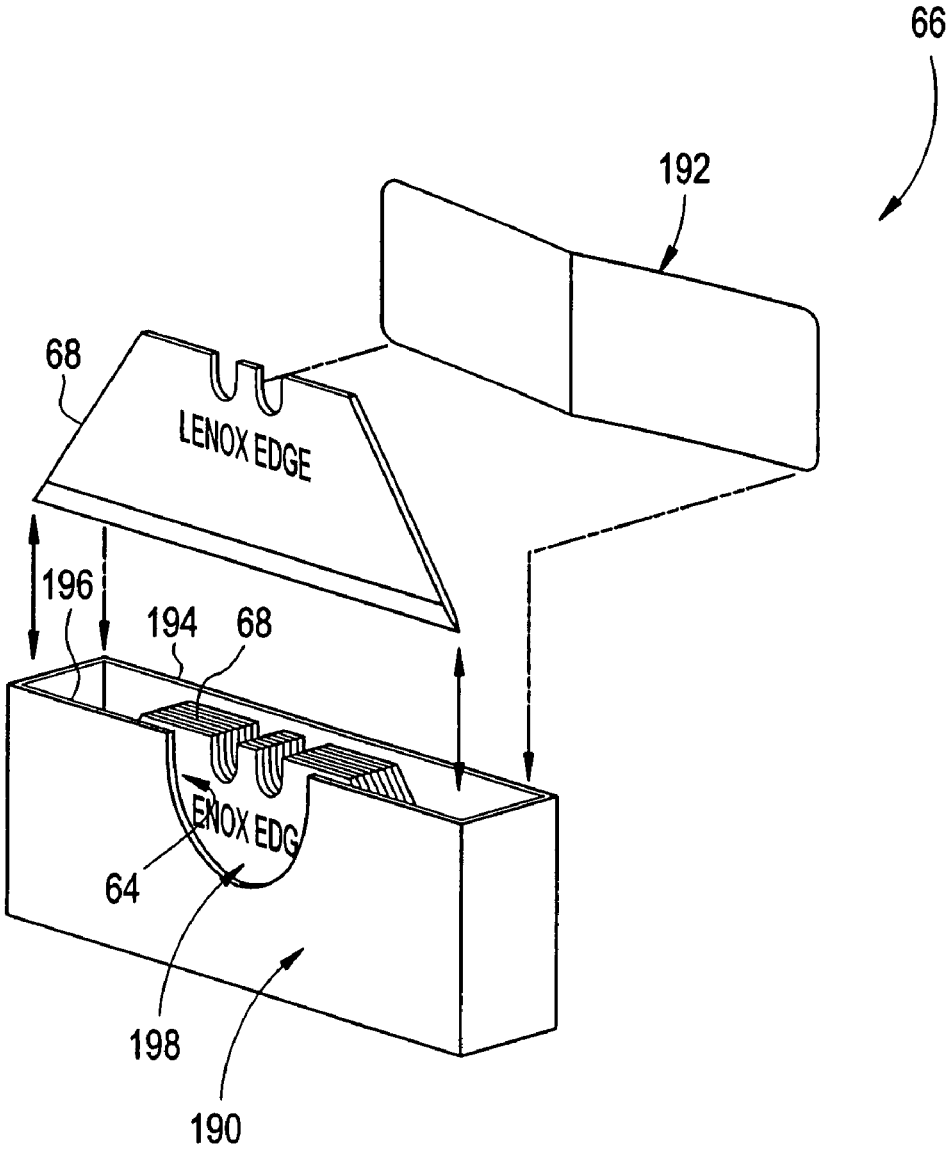
FIG. 16 is a perspective view of the spare blade holder portion of the utility knife of FIG. 1 in a disassembled state.

As shown in FIG. 16, the spare blade holder assembly 66 includes a molded plastic holder 190, a spring or spring-like member 192 and a stack of spare blades 68. The holder 190 may be substantially rectangular and oriented so as to cause the stack of spare blades 68 to be oriented perpendicular to the blade 68 in use. This makes it easier to remove a spare blade from the holder 190. The spring or spring-like member 192 is disposed inside the holder 190, and more particularly, between opposing side walls 194, 196 so as to bias the stack of spare blades 68 toward one wall 196 of said opposing walls 194, 196. The holder 190 may define a notch or cutout 198, which allows an operator to use his finger to engage the front surface of a spare blade 64 disposed in the stack 68 in order to more easily slide the spare blade out of the holder 190. As shown in FIG. 8, ribs 200 on the rear portion 82 are positioned so as to secure the holder and provide the desired orientation. Ribs 202 on the second housing portion 78 are positioned to keep the holder from sliding out from between the ribs 200 while the handle is in the closed state.

Figure 28:
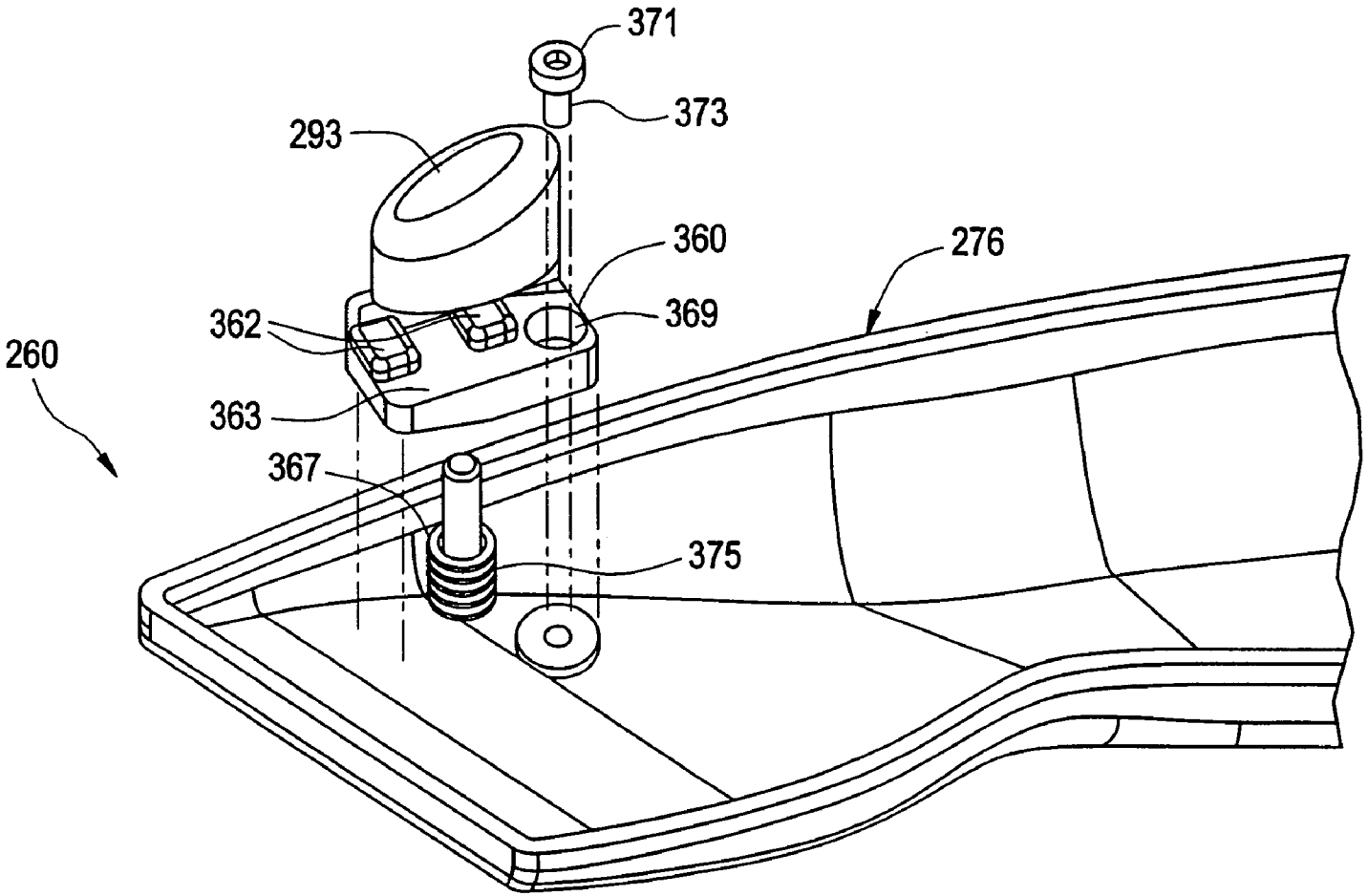
FIG. 28 is a perspective view showing a second embodiment of a rear portion of the first housing portion and a second embodiment of a mechanism for releasably engaging a blade, shown in a disassembled state.
Figure 29:
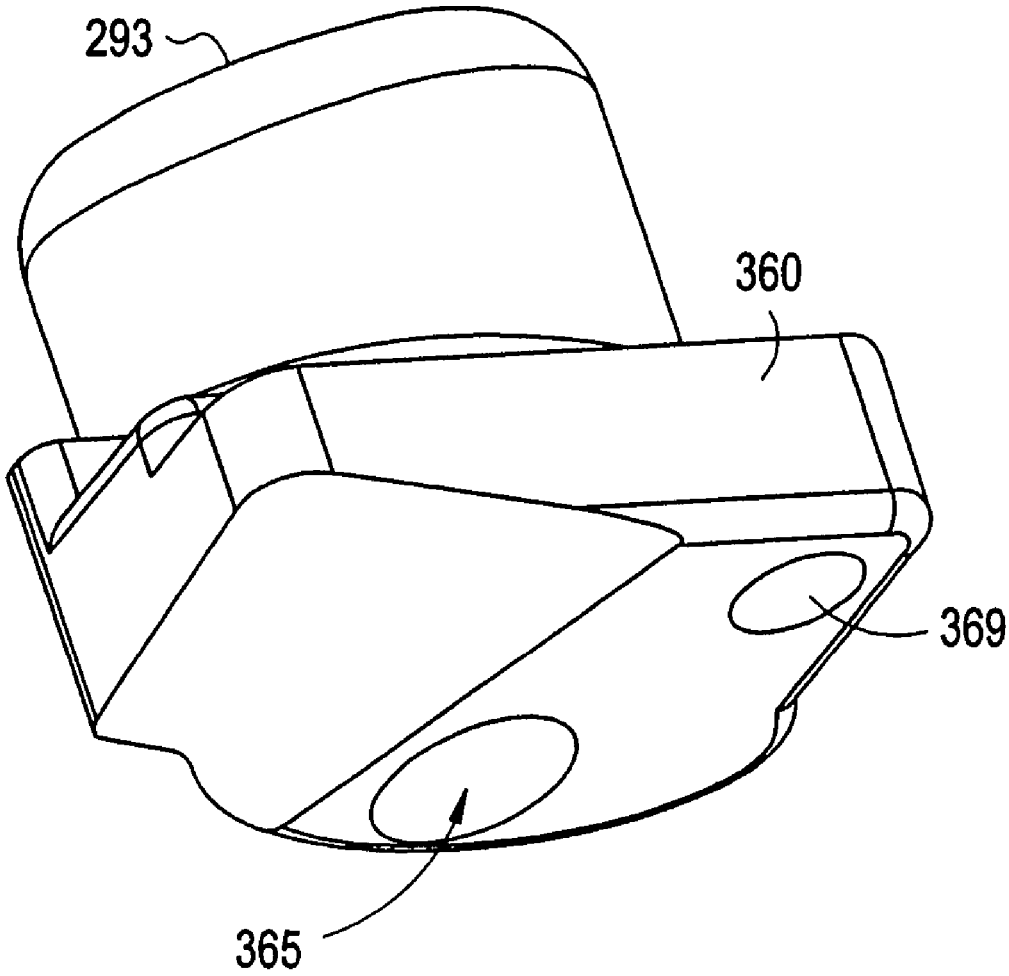
FIG. 29 is another perspective view of the mechanism shown in FIG. 28 for releasably engaging a blade.
Figure 30:
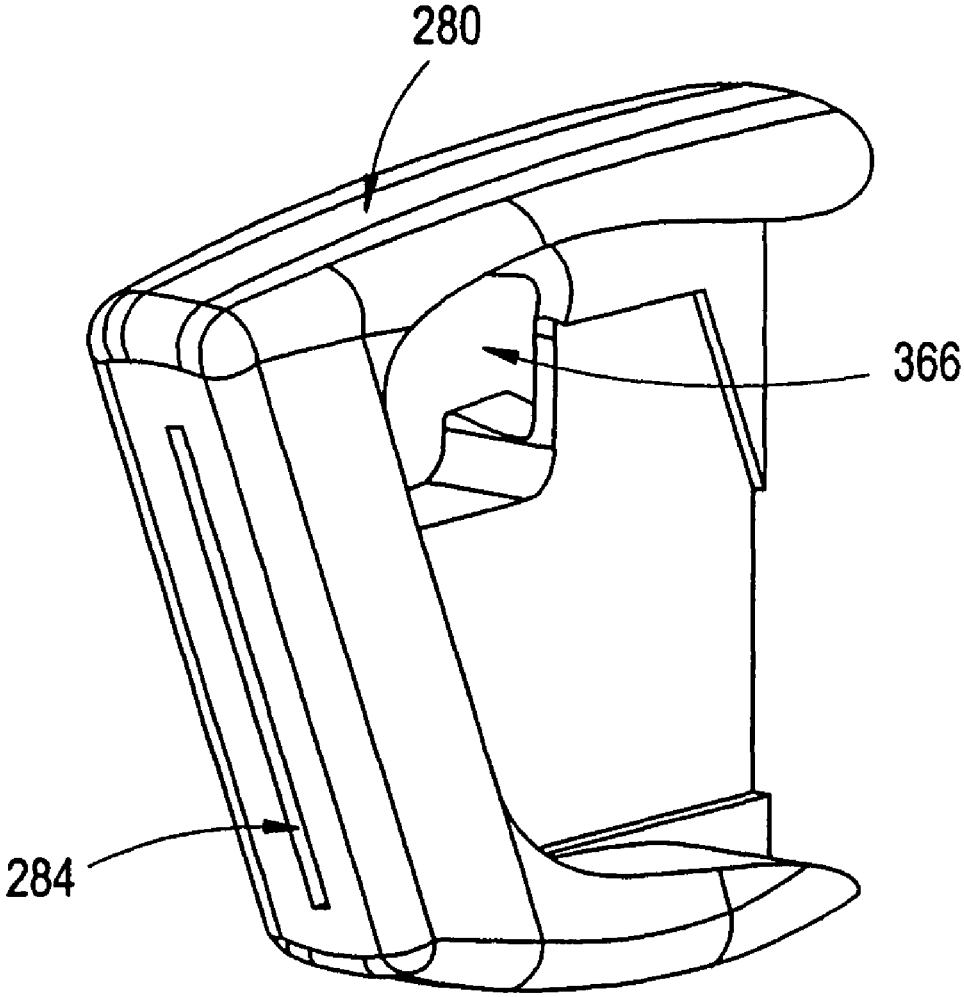
FIG. 30 is a perspective view of a second embodiment of a nose portion, which may be used in association with the rear portion and mechanism of FIG. 28.
Figure 31:
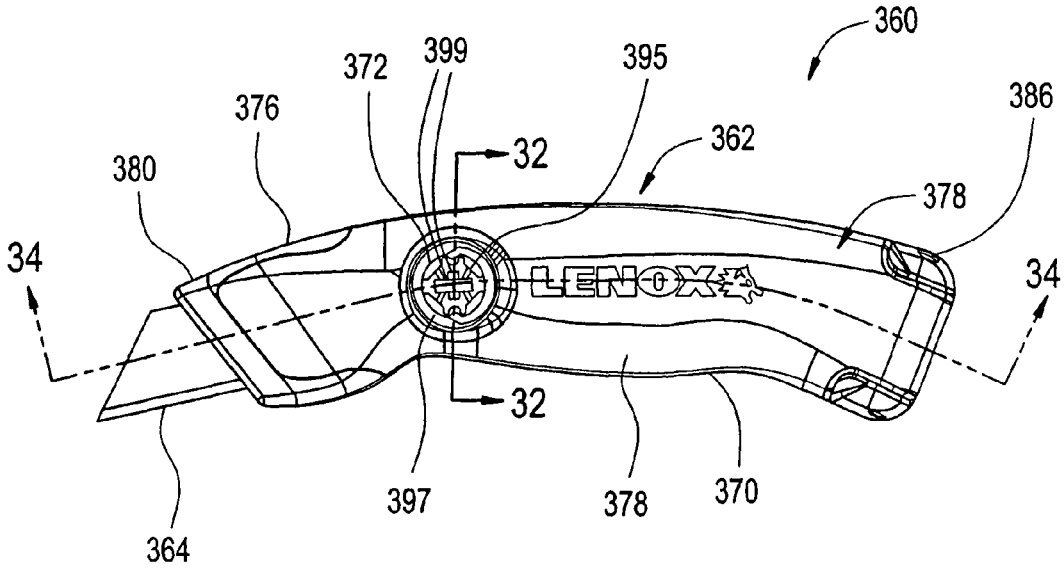
FIG. 31 is a side elevational view of a third embodiment of a utility knife that does not include a manually engageable button for releasing the blade, but rather includes a fastener for both releasably holding the two portions of the housing together and for releasably engaging the blade.

FIGS. 28-30 show a portion of another utility knife indicated generally at 260, in a disassembled state. The utility knife 260 is substantially similar to the utility knife 60 described above, and therefore like reference numerals preceded by the numeral "2", or preceded by the numeral "3" instead of the numeral "1", are used to indicate like elements. One of the primary differences of the utility knife 260 in comparison to the utility knife 60 relates to the mechanism for releasably engaging the stationary blade 64. In the knife 260, the mechanism for releasably engaging the stationary blade 64 includes a support member 360, a catch 362, a blade support surface 363 and a manually operable button 293. The support member 360, the catch 362, the blade support surface 363 and the manually operable button 293 may be integrally formed into a single component, as shown, although this is not required.

As with the support member 160 described hereinabove, the support member 360 is also retained to the first housing portion 276. In this regard, the base of the support member 360 defines a recess 365 to slidably receive a transverse support member 367 that extends transversely from the first housing portion 276. The support member 360 further defines an opening 369 to receive a fastener 371 (e.g., a screw or pin). The fastener 371 has a first end 373 that engages the first housing portion 276 and a second end defining a head that is sized larger than the hole so as to retain the support member 360 to the first housing portion 276 and thereby prevent the support member (including the catch and button) from becoming separated from the housing in the event that the housing is opened. The catch 362 and button 293 extend through an opening 366 defined by the nose portion 280.

The catch 362 extends from the support member 360 and defines a shape that is approximately complementary to the shape of the notch(es) in the blade 64. A biasing member 375 is disposed between the first housing portion 276 and the support member 360. The biasing member 375 is shown as a spring (or spring-like member) having one end that abuts the handle and has another end that abuts a wall at the end of the recess, however any type of biasing member may be used. The biasing member may also be disposed circumferentially about the transverse support member 367 whereby the transverse support member guides the biasing member and/or captures the biasing member to the housing.

The manually operable button 293 extends transversely from the support member 360. The button 293 is disposed generally in register with an opening in a second housing portion (not shown) so that the button 293 is received by, or can be manually operated through, such opening.

The operation of the mechanism is as follows. The biasing member 375 biases the catch 362 toward a blade engaging position (e.g., toward a second housing portion (not shown)) wherein the catch 362 engages the notches 107 of the blade 64 to retain the blade 64 in the handle 260. Manually depressing the button 293 forces the catch 362 out of its blade engaging position (e.g., toward the first housing portion) wherein the blade 64 may be removed through the blade opening 84, and reversed, or a new blade inserted.

One advantage of the above described mechanism is the provision of a new type of biased catch. Another advantage of the above mechanism is that the manually operable member is retained to the first portion of the housing and therefore does not become separated from the housing when the housing is in the open state.

Figure 32:
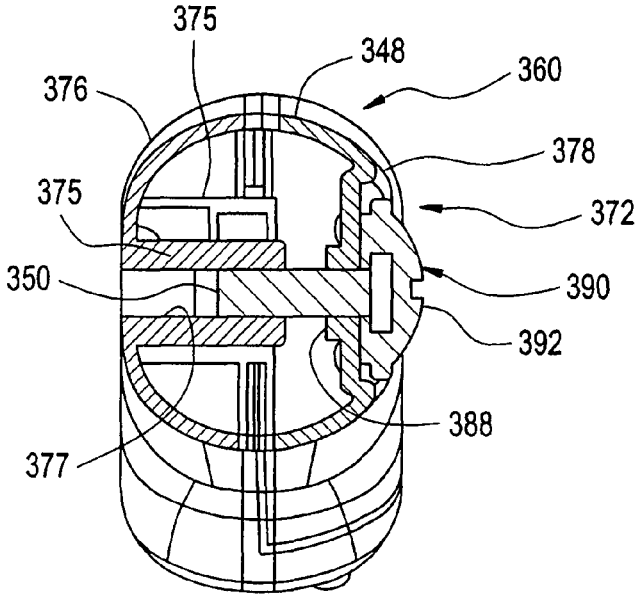
FIG. 32 is a cross-sectional view of the utility knife of FIG. 31 taken along line 32-32 of FIG. 31.
Figure 33:
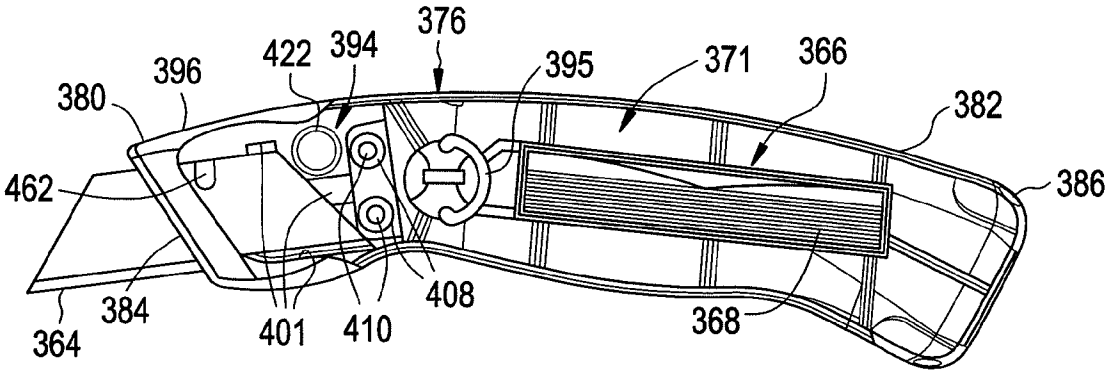
FIG. 33 is a side elevational view of the utility knife of FIG. 31 with parts of the second housing portion removed to show the interior of the handle.
Figure 34:
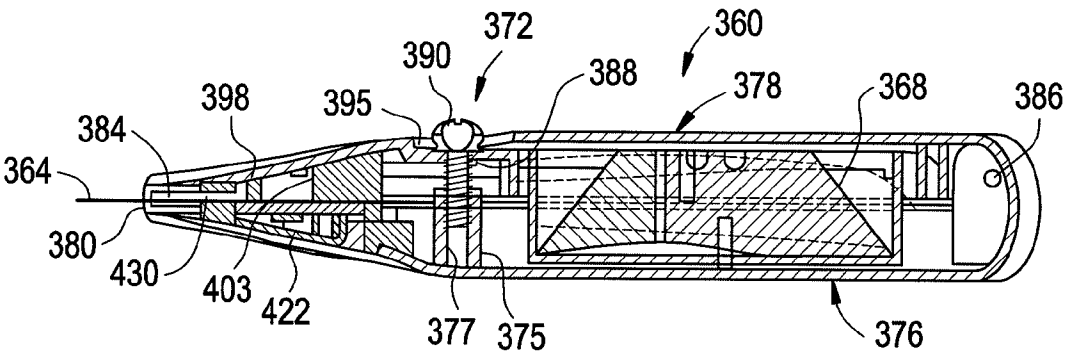
FIG. 34 is a cross-sectional view of the utility knife of FIG. 31 taken along line 34-34 of FIG. 31.

In FIGS. 31-35, another utility knife is indicated generally by the reference numeral 360. The utility knife 360 is substantially similar to the utility knife 60 described above, and therefore like reference numerals preceded by the numeral "3", or preceded by the numeral "4" instead of the numeral "1", are used to indicate like elements. One of the primary differences of the utility knife 360 in comparison to the utility knife 60, is that the utility knife 360 does not include a manually engageable button for releasing the blade, but rather includes a single mechanism 372 that functions both to releasably hold the two portions of the housing together and to releasably engage the blade. More specifically, the mechanism 372 includes a fastener 390 including a head 392, a shaft 348, and a threaded end portion 350. As can be seen in FIGS. 32 and 34, the shaft 348 is slidably received through the aperture 388 formed in the second housing portion 378. The fastener 390 is captured on the second housing portion 378 by the fastener head 392 located on one side of the fastener aperture 388, and by the threaded end portion 350 located on the other side of the fastener aperture 388. The threaded end portion 350 of the fastener 390 defines a major thread or outer diameter that allows the threaded end portion to be threaded through the fastener aperture 388, but otherwise prevents the threaded end portion from passing through the fastener aperture in the opposite direction without rotating the fastener. Alternatively, the threaded end portion 350 may be formed after the fastener shaft 348 is passed through the fastener aperture 388 to increase the diameter of the end portion through the formation of the threads, and thereby capture the fastener to the second housing portion 378. As shown in FIGS. 32 and 34, the rear portion 382 of the first housing portion 376 includes a boss 375 defining a threaded bore 377 for threadedly receiving therein the threaded end portion 350 of the fastener 390.

In the illustrated embodiment, the fastener 390 is in the form of a bail screw including a bail member 395 pivotally mounted on the head 392, and which as described further below, is manually engageable and pivotable laterally outwardly to rotate the screw to open and close the housing 370. During non-use, the bail member 395 is pivotable laterally inwardly and received within an annular recess 395 formed in the exterior wall of the second housing portion 378, and extending about the periphery of the fastener head 392 to maintain the fastener head substantially flush with, or raised slightly outwardly from, the exterior surface of the second housing portion 378. In the illustrated embodiment, the head 392 of the fastener 390 also defines on its exposed face both Phillips head and slot head recesses 399 for receiving a Phillips head driver, or a slot head driver, respectively, to thereby allow the fastener 390 to be engaged and rotated with a screw driver if desired. Although in the illustrated embodiment the fastener 390 is a bail screw, any of numerous other types of fasteners that are currently known, or that later become known, equally may be employed. For example, more than one fastener may be employed, or another type of mechanism that allows the second housing portion 378 to be releasably secured in the closed position to, in turn, fixedly secure the blade 364 on the blade support surface 398 (FIG. 35) in the cutting position, as shown. Such alternative mechanism preferably allows the second housing portion 378 to be spaced away from the first housing portion 376 at one or more intermediate positions located between the fully closed position and the fully opened position to thereby allow the blade 364 to be removed through the blade aperture 384, and flipped and re-inserted, or replaced with a fresh blade, as described further below.

Figure 34A:
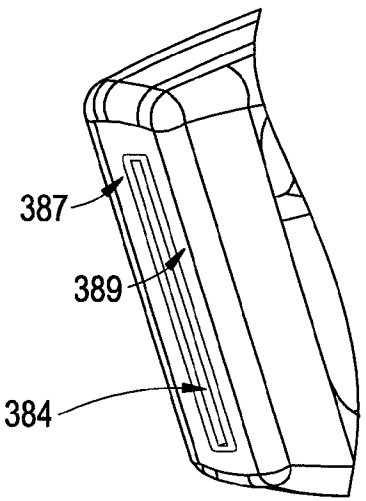
FIG. 34A is a perspective view of the nose section of an embodiment of the utility knife showing a chamfered blade aperture.
Figure 35:
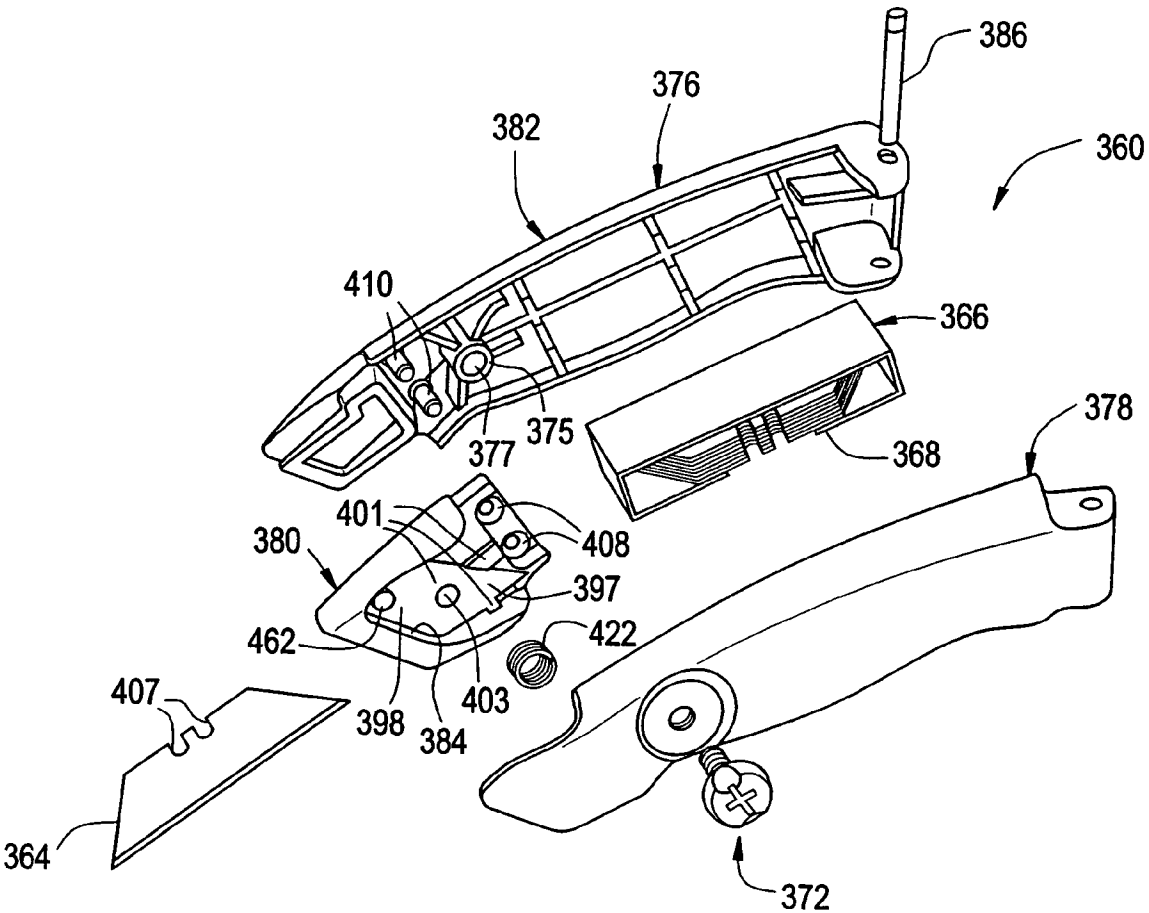
FIG. 35 is an exploded, perspective view of the utility knife of FIG. 31.

The nose portion 380 defines a fixed, substantially D-shaped tab or catch 462 that is received within the corresponding notch 407 formed in the blade 364 to locate or register the blade on the blade support surface 398. In the illustrated embodiment, the D-shaped tab or catch 462 defines a thickness approximately equal to the thickness of the blade 364. The width of the blade opening 384, on the other hand, is at least about twice the thickness of the blade 364 to allow the blade to be lifted or moved laterally over the catch 462 and moved either into or out of the nose through the blade aperture 384. In the illustrated embodiment, the width of the blade opening 384 in the nose 380 is approximately two times the thickness of the blade 364. However, as may be recognized by those of ordinary skill in the pertinent art based on the teachings herein, this width is only exemplary, and the width may be narrower or wider than approximately two times the thickness of the blade. For example, the width of the blade aperture 384 may be more narrow, and only slightly greater than the thickness of the blade 364 to, for example, provide lateral support for the blade; however, in embodiments such as shown in FIG. 34A, one or more edges 387, 389 defining the inlet to the blade aperture may be chamfered to allow the blade to be inserted into the nose at an acute angle relative to the blade support surface 398. The nose portion 380 also defines three laterally-extending edge tabs 401 that are angularly spaced about 90° relative to each other about the periphery of the blade-receiving recess 397 for locating and retaining the blade in position on the blade support surface 398. As can be seen, a first tab 401 is located to engage the top edge 400 of the blade 364, a second tab 401 is located to engage the rear edge 404 or 406 of the blade, and a third tab 401 is located to engage the lower or cutting edge 402 of the blade. The edge tabs 401 prevent the blade from becoming cocked, or otherwise moving out of registration with the edges of the blade support surface 398 and recess 397 when excessive force is applied thereto during use. The nose portion 380 also includes a magnet 403 fixedly received within a corresponding recess formed in the blade support surface 398 to releasably retain the blade on the blade support surface. As shown in FIG. 34, the exposed surface of the magnet 403 is substantially flush with the blade support surface 398. The magnet 403 facilitates in preventing the blade 364 from falling out of the housing 370 when opened, and also facilitates in properly locating the blade 364 on the blade support surface 398 during blade installation.

As described above, the nose portion 380 is more wear resistant than the other portions of the housing 370. In the illustrated embodiment, the nose portion is formed of a 300 series stainless steel, such as 316 stainless steel, and is formed by metal injection molding ("MIM"). The MIM nose portion 380 is assembled to the rear housing portion 382 in the manner described above, i.e., the ends of the bosses 410 are peened or otherwise deformed laterally over the edges of the corresponding apertures 408, and an adhesive, such as a one-part cyanoacrylate, is applied to the interface of the nose portion 380 and rear housing portion 382 adjacent to the bosses 410 and corresponding apertures 408, to fixedly secure the nose portion 380 to the rear housing portion 382. As may be recognized by those of ordinary skill in the pertinent art based on the teachings herein, these materials, methods of forming, and methods of assembly are only exemplary, and numerous other materials, methods of forming, and/or methods of assembly, that are currently known, or that later become known, equally may be used.

In the illustrated embodiment, the nose portion 380 is physical vapor deposition ("PVD") coated to further improve its durability, wear resistance and corrosion resistance, and if desired, to provide an aesthetically pleasing appearance. In the illustrated embodiment, the nose portion 380 is PVD coated with titanium nitride ("TiN") in a manner known to those of ordinary skill in the pertinent art prior to assembling the nose portion 380 to the rear housing portion 382 as described above. One advantage of the TiN coated nose portion is that it provides greater wear resistance and corrosion resistance in comparison to a nose portion without any such coating. As indicated above, the nose portion 380 is located adjacent to the blade 364, and therefore frictionally engages during use the work pieces or other surfaces being cut. Accordingly, the nose portions of utility knives tend to wear more rapidly, and/or tend to be subject to more corrosive agents, than other portions of such knives. Accordingly, another advantage of the PVD coated nose portion of the utility knife 360 is that the coating preferably is applied only to the portion or part of the utility knife most subject to wear or corrosion, which in the illustrated embodiment is the nose portion. Preferably, the nose portion 380 is PVD coated prior to assembling the nose portion 380 to the rear housing portion 382. As a result, the amount of coating required is minimized, and the coating process is simplified in comparison to coating the nose portion 380 only after it is assembled to the rear housing portion.

In the operation of the utility knife 360, the housing 370 is opened by manually engaging the bail 395 and rotating the fastener 390 in the counter-clockwise direction to release the threaded end portion 350 thereof from the threaded boss 375 of the first housing portion 376. If desired, a Phillips head or slot head driver may be used instead to rotate the fastener 390. Rotation and release of the fastener 390, in turn, allows the spring 422 to bias the second housing portion 378 laterally outwardly and away from the first housing portion 376. When the threaded end portion 350 is fully released from the threaded bore 377 of the boss 375, the user may pivotally move the two housing portions 376, 378 apart from each other and into the fully open position in the same manner as described above in connection with the other embodiments. In the fully open position of the housing 370, the user may remove one or more blades 364 from the stack 368 within the spare blade holder 366, or may install one or more fresh blades 364 into the spare blade holder 366. In addition, the user may remove the blade 364 through the blade aperture 384 of the nose portion 380 and replace the blade with a fresh blade, or may remove the blade through the blade aperture 384, flip the blade over, and reinsert the same blade through the blade aperture to present the other side of the cutting edge of the blade for use. The user then closes the housing 370 by pivoting the first and second housing portions 376, 378 toward each other and into the closed position of FIG. 31. The catch 362 is then releasably locked in the closed position by manually gripping the bale 395, or alternatively using a driver as described above, and rotating the fastener 390 in the clockwise direction until second housing portion 378 fully engages the first housing portion 376. In the fully closed position, the serpentine ribs 430 on the inner side of the second housing portion 378 engage the blade 364 and laterally secure the blade against the blade support surface 398.

A significant advantage of the utility knife 360 is that the blade 364 may be removed from the nose 380 and replaced, or removed and re-inserted into the nose, without fully opening the housing 370. When the housing is in the fully closed position, the user may rotate the fastener 390 in the counterclockwise direction about two turns (i.e., a plurality of turns, but less than the number of turns required to fully open the housing). This, in turn, causes the spring 422 to bias the second housing portion 378 laterally outwardly and away from the blade 364. In this position, the blade 364 may be lifted laterally away from the blade support surface 398 and over the D-shaped tab or catch 362, and in turn, removed through the blade aperture 384. The blade 364 then may be flipped and re-inserted through the blade aperture 384 to present a fresh side of the cutting edge for use, or another blade may be installed through the blade aperture 384. Once the blade 364 is received within the blade aperture 384 and seated on the blade support surface 398, the user then rotates the fastener 390 in the clockwise direction until the second housing portion 378 engages the first housing portion 376, and the serpentine ribs 430 fully engage the blade 364 to secure the blade in the cutting position (about two turns, or the same number of turns required to move the second housing portion from the fully closed position to the intermediate or partially opened position).

Figure 36:
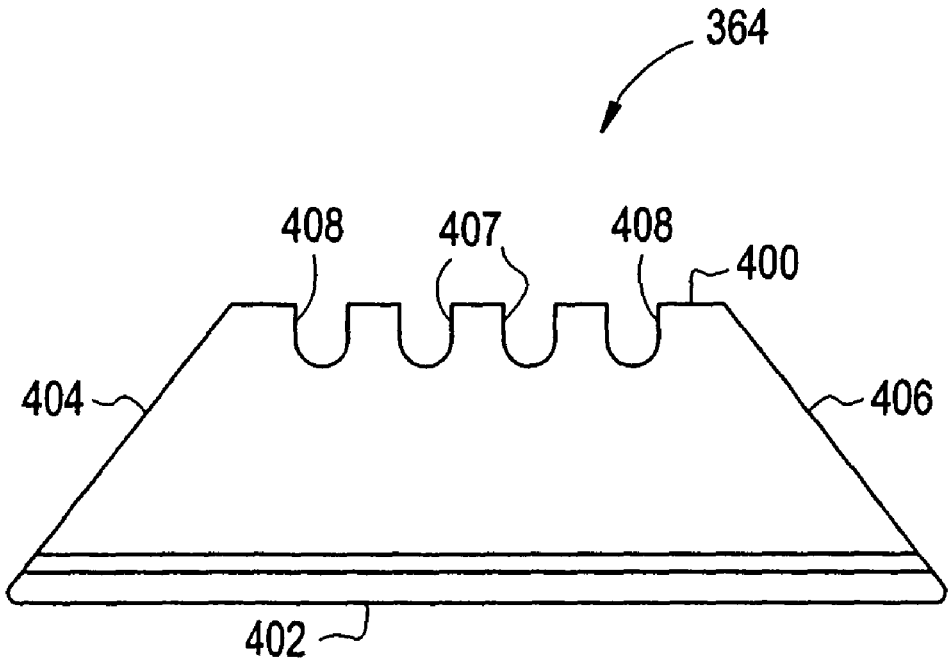
FIG. 36 is a side elevational view of a utility blade that is usable in the utility knives of the present invention and that includes four notches in the upper edge of the blade to provide two cutting positions for each side of the cutting edge of the blade.

In FIG. 36, an alternative utility blade usable with the utility knives of the present invention is indicated generally by the reference numeral 364. The primary difference of the utility blade 364 in comparison to the utility blade 64 described above, is that the utility blade 364 defines in its upper edge 400 two inner notches 407 and two outer notches 408. Accordingly, each side of the blade defines two cutting positions, a first cutting position with the catch 162 or 362 received within the respective inner notch 407, and a second cutting position with the catch 162 or 362 received within the respective outer notch 408. In the illustrated embodiment, when the blade 364 is located in the first cutting position, about 50% of the cutting edge 402 extends outwardly of the blade aperture 384 and is exposed for cutting. In the second cutting position, on the other hand, a greater portion of the cutting edge 402 extends outwardly of the blade aperture 384 in comparison to the first cutting position. In the illustrated embodiment, in the second cutting position, about 60% of the cutting edge 402 extends outwardly of the blade aperture 384 and is exposed for cutting. If desired, the blades 64 and 364 may be any of the different types of composite utility blades disclosed in the following patent and co-pending patent applications, which are assigned to the Assignee of the present invention and are hereby expressly incorporated by reference as part of the present disclosure: U.S. Pat. No. 6,701,627 issued Mar. 9, 2004, entitled "COMPOSITE UTILITY KNIFE BLADE AND METHOD OF MAKING SUCH A BLADE"; U.S. patent application Ser. No. 10/202,703 filed Jul. 24, 2002, entitled "Composite Utility Knife Blade and Method of Making Such a Blade"; and U.S. patent application Ser. No. 10/793,593 filed Mar. 4, 2004, entitled "COMPOSITE UTILITY BLADE AND METHOD OF MAKING SUCH A BLADE". One advantage of such composite utility blades is that they are bendable and virtually shatter-proof. As a result, such blades are particularly well suited to defining four notches 407, 408, as opposed to only two notches as in conventional utility blades, because when located in the fully extended, second cutting position, such blades can be subjected to relatively high lateral forces and bending without shattering or otherwise breaking.

If desired, one or more components of the utility knives disclosed herein may be the same as, or similar to corresponding components described in commonly assigned U.S. Provisional Patent Application entitled "UTILITY KNIFE WITH ACTUATOR FOR MOVING BLADE CARRIER AND FOR RELEASING BLADE THEREFROM, AND RELATED METHOD", filed on Nov. 10, 2003 and accorded Ser. No. 60/518,690, incorporated by reference above. Further, one or more of the methods employed in any of the knives disclosed herein may be the same as, or similar to corresponding methods described in the above mentioned commonly assigned U.S. Provisional Patent Application.

As may be recognized by those of ordinary skill in the pertinent art based on the teachings herein, numerous changes may be made to the above-described and other embodiments of the present invention without departing from the scope of the invention as defined in the appended claims. For example, numerous different types of coatings may be employed to coat the nose portion or other portions of the utility knife, including carbide coatings, nitride coatings, and combinations thereof. Coatings intended to reduce the rate of wear of the nose portion may comprise, for example, any suitable material(s) including but not limited to titanium nitride (TiN), chrome nitride (CrN), titanium carbide (TiC), ceramic(s), titanium carbonitride (TiCN), Aluminum Titanium Nitride (AlTiN), Aluminum Titanium Carbonitride (AlTiCN), Zirconium Nitride (ZrN), Zirconium Carbonitride (ZrCN), and/or combinations thereof. In one exemplary embodiment, the nose portion is coated with an inner layer of AlTiN and an outer layer of TiN for a gold-colored appearance. The AlTiN coatings are applied to the nose portion in a thickness within the range of about 3 micrometers to about 5 micrometers. In the embodiment employing an inner coating of AlTiN and out outer coating of TiN, the outer coater is thinner than the inner coating. In one such embodiment, the AlTiN coating is applied so as to provide a gradient (linear or otherwise) such that the concentration of aluminum increases from a first lesser concentration at the substrate surface to a second greater concentration at the outer surface of the coating. One advantage of this configuration is that the higher concentration of titanium at the substrate/coating interface facilitates adhesion of the coating to the substrate.

As indicated above, the coating(s) may be provided using physical vapor deposition (PVD). Physical vapor deposition may be carried out in any suitable manner including but not limited to using cathodic arc deposition, thermal/electron beam deposition, and/or sputter deposition. However, coatings also may be provided by other methods. Indeed, coatings may be provided using any suitable manner including but not limited to painting, spraying, brushing, dipping, plating (electroplating or electro-less plating), physical and/or chemical vapor deposition, or any combination thereof. Powder coatings and e-coatings, and/or combinations of any of the above, also may be employed.

Although the housing is shown having two separate portions that are pivotally connected to one another, this is not a requirement. For example, the housing may be formed of any number of separate portions. Such portions may be connected in any manner, completely separable from one another, and/or combinations thereof.

As stated above, there is no requirement for, or against, all portions of the housing being formed of the same type of material. Thus, for example, one portion of the housing may be made of a material that is more wear resistant than another portion, for example, in order to increase the durability of some portion(s).

Although shown attached to the first housing portion, the mechanism for releasably retaining the blade need not be retained to the housing and/or prevented from becoming separating from the housing when the housing is in the opened state.

Furthermore, although the blade 64 defines a trapezoidal shape, each of the various aspects of the present invention may be used in association with blade(s) of any shape and type, for example, but not limited to, blades that define rectangular or parallelogram shapes, blades with squared, rounded or oblique cutting corners, and combinations thereof.

In addition, although the notches in the blade are shown as approximately semi-circular, the notches are not limited to such. For example, a notch may take other shapes and/or configurations in the same or other locations on the blade. In addition, although the blade is shown having two notches, the blade may alternatively have one notch, no notches, or more than two notches.

Also, the utility knives of the present invention may comprise some but not all of the features disclosed herein. For example, a utility knife of the present invention may comprise the relatively wear resistant nose portion 80, 380, but not comprise the mechanism 72, the mechanism 74 or the bail screw 390. Alternatively, a utility knife of the present invention may comprise the mechanism 72, the mechanism 74, or the bail screw 390, but not the relatively wear resistant nose portion 80, 380.

Note that, except where otherwise stated, phrases such as, for example, "extends transversely" mean "extends in a direction that has, but is not limited to, a transverse component." Thus, for example, "extends transversely" means "extends in a direction that is purely transversely" or "in a direction that has a transverse component in addition to an axial and/or circumferential component", which includes but is not limited to, "substantially transversely".

Also note that, except where otherwise stated, the term "retain" means "releasably retain" or "permanently retain".

Note that, except where otherwise stated, phrases such as, for example, "connected to" mean "connected directly to" or "connected indirectly to".

Also note that, except where otherwise stated, terms such as, for example, "comprises", "has", "includes", and all forms thereof, are considered open-ended, so as not to preclude additional elements and/or features.

Thus, while there have been shown and described various embodiments, it will be understood by those skilled in the art that the present invention is not limited to such embodiments, which have been presented by way of example only, and that various changes and modifications may be made without departing from the spirit and scope of the invention. Accordingly, the invention is limited only by the appended claims and equivalents thereto.

What is claimed is:

1. A utility knife comprising:

a housing defining an internal cavity and a blade opening at a first end, the housing including two portions movable relative to one another and the blade opening defined in one of the two housing portions, wherein a first positioning of the two portions defines a fully open state of the housing allowing access to the internal cavity, and a second positioning of the two portions defines a fully closed state of the housing preventing access to the internal cavity between the two portions;

a mechanism that releasably secures the two portions of the housing in the fully closed state, a biasing member positions at least one of the two portions relative to the other in at least one intermediate state between the fully closed state and the fully open state;

a catch disposed in the internal cavity; and a blade received within the blade opening, wherein in the fully closed state, the blade is engaged by the catch and fixedly secured within the blade opening, and in the intermediate state, the blade is manually movable laterally relative to and disengaged from the catch and is movable in a longitudinal direction of the knife through the blade opening, wherein the one of the housing portions is so configured so that the blade is not laterally removable from the blade opening in the fully open state when the blade is in a cutting position and extends outwardly of the blade opening and is exposed for cutting.

2. A utility knife as defined in claim 1, wherein the mechanism comprises a fastener connected to one of the two housing portions, and releasably connectable to the other of the two housing portions.

3. A utility knife as defined in claim 2, wherein the fastener comprises a threaded portion, and the other housing portion includes a plurality of threads for threadedly engaging the threaded portion of the fastener in the closed and intermediate states.

4. A utility knife as defined in claim 3, wherein the fastener is a bail screw.

5. A utility knife as defined in claim 4, wherein the bail screw includes a bail member pivotally mounted thereon that is manually engageable for rotating the bail screw.

6. A utility knife as defined in claim 2, wherein the fastener defines both Phillips head and slot head screw driver recesses for engaging the fastener with a screw driver and rotating the fastener.

7. A utility knife as defined in claim 1, wherein the one of the two housing portions further defines a blade support surface, the catch is located adjacent to the blade support surface and locates the blade on the blade support surface, and in the second positioning of the two portions of the housing the other of the housing portions engages the blade against the blade support surface to secure the blade in the cutting position thereon.

8. A utility knife as defined in claim 1, wherein the biasing member is coupled to at least one of the two housing portions that biases at least one of the two housing portions in a direction from the closed state toward the intermediate state.

9. A utility knife as defined in claim 8, wherein the biasing member is a spring.

10. A utility knife as defined in claim 1, wherein the width of the blade opening is greater than a thickness of the blade to allow in an intermediate state of the two portions of the housing the blade to be manually engaged and moved over the catch and into or out of the blade opening.

11. A utility knife as defined in claim 10, wherein at least one edge defining an inlet to the blade opening is chamfered to allow the blade to be inserted into the blade opening at an acute angle relative to a blade support surface of the housing.

12. A utility knife as defined in claim 1, wherein the blade is a utility blade defining along an edge thereof four notches substantially equally spaced relative to each other, including two inner notches and two outer notches, wherein each inner notch is engageable with the catch for defining a first respective cutting position of the blade, and each outer notch is engageable with the catch for defining a second respective cutting position of the blade, and in the second cutting position a greater portion of the cutting edge of the blade extends outwardly of the blade opening than in the first cutting position.

13. A utility knife as defined in claim 1, further comprising within the internal cavity a blade support surface for receiving and supporting thereon the blade, and a magnet disposed on the blade support surface for releasably retaining the blade on the blade support surface.

14. A utility knife as defined in claim 1, wherein the housing includes at least two metal portions, a first one of the at least two metal portions is more wear resistant than a second one of the at least two metal portions, the first metal portion comprises a nose portion of the housing defining the blade opening, and the second metal portion defines a rear portion disposed to the rear of the first metal portion.

15. A utility knife as defined in claim 14, wherein the nose portion includes a wear-resistant coating on an exterior surface thereof.

16. A utility knife as defined in claim 15, wherein the coating is at least one of TiN and AlTiN.

17. A utility knife as defined in claim 1, wherein the blade is not laterally removable from the blade opening regardless of the relative position of the two portions.

18. A utility knife as defined in claim 1, wherein the mechanism includes a manually-rotatable member and the at least one intermediate position is obtained by rotation thereof.

19. A utility knife as defined in claim 1, wherein the biasing member positions the two portions from the fully closed state so that the blade is no longer fixedly secured within the opening.

20. A utility knife as defined in claim 19, wherein the biasing member positions the two portions from the fully closed state toward the fully open state.

21. A utility knife as defined in claim 1, wherein the fully open state allows access to the internal cavity through an open space between the two portions.

22. A utility knife as defined in claim 1, wherein the two portions are connected to each other in the fully open state.

23. A utility knife as defined in claim 1, wherein the two portions are pivotally connected.

24. A utility knife as defined in claim 1, wherein the housing fully encloses the internal cavity in the closed state.

25. A utility knife as defined in claim 1, wherein the two portions are pivotally connected and laterally pivot between the closed state and the open state.

26. A utility knife comprising:

a housing defining an internal cavity and a blade opening, and including first and second housing portions movable relative to one another and the blade opening defined in one of the two housing portions, wherein a first positioning of the first and second housing portions defines a fully open state of the housing, and a second positioning of the first and second housing portions defines a fully closed state of the housing;

a fastener connectable between the first and second housing portions, wherein the fastener releasably secures the first and second housing portions in the fully closed state, and a biasing member positions at least one of the first and second housing portions in at least one intermediate state between the fully closed state and the fully open state;

a blade support surface located adjacent to the blade opening for receiving and supporting thereon a utility blade; and a catch for engaging the blade on the blade support surface;

wherein (i) in the fully closed state, the utility blade is engaged by the catch and fixedly secured to the blade support surface, (ii) in the intermediate state, the utility blade is manually movable laterally relative to and disengaged from the catch and the blade support surface, and is movable in a longitudinal direction of the knife through the blade opening, and (iii) in the fully open state, the one of the two housing portions is so configured so that the blade is not laterally removable from the blade opening when the blade is in a cutting position and extends outwardly of the blade opening and is exposed for cutting.

27. A utility knife as defined in claim 26, further comprising a biasing member biasing at least one of the first and second housing portions in a direction from the closed state toward the intermediate state.

28. A utility knife as defined in claim 26, wherein the fastener includes a manually operable member that is manually engageable to move the fastener and, in turn, allow movement of the two housing portions between the fully closed state, the at least one intermediate state, and the fully open state.

29. A utility knife as defined in claim 26, wherein the catch locates the blade on the blade support surface, and in the fully closed state of the two portions of the housing the other of the housing portions engages the blade against the blade support surface to secure the blade in the cutting position thereon.

30. A utility knife comprising:

a housing defining an internal cavity and a blade opening, and including first and second housing portions movable relative to one another and the blade opening defined in one of the two housing portions, a first positioning of the first and second housing portions defining a fully open state of the housing, and a second positioning of the first and second housing portions defining a fully closed state of the housing; and means first means for releasably securing the first and second housing portions in the fully closed state and, in turn, releasably securing a blade within the blade opening, and second means for positioning at least one of the first and second housing portions in at least one intermediate state located between the fully closed state and the fully open state and, in turn, permitting the blade to be manually moved through the blade opening, a catch disposed in the internal cavity; and a blade received within the blade opening, wherein in the fully closed state, the blade is engaged by the catch and fixedly secured within the blade opening, and in the intermediate state, the blade is manually movable laterally relative to and disengaged from the catch and is movable in a longitudinal direction of the knife through the blade opening, wherein the one of the housing portions is so configured so that the blade is not laterally removable from the blade opening in the fully open state when the blade is in a cutting position and extends outwardly of the blade opening and is exposed for cutting.

31. A utility knife as defined in claim 30, wherein the means is a fastener connected with one of the first and second housing portions, and releasably engageable with the other of the first and second housing portions in the closed and intermediate states.

32. A utility knife as defined in claim 30, wherein the second means biases at least one of the first and second housing portions in a direction from the fully closed state to at least one of the intermediate and fully open states.

33. A utility knife as defined in claim 32, wherein the second means is a spring connected to at least one of the first and second housing portions.

* * * * *

UNITED STATES PATENT AND TRADEMARK OFFICE

CERTIFICATE OF CORRECTION

PATENT NO. : 8,069,569 B2
APPLICATION NO. : 11/895942
DATED : December 6, 2011
INVENTOR(S) : Donald A. Brown et al.

It is certified that error appears in the above-identified patent and that said Letters Patent is hereby corrected as shown below:

On the Title Page, Item (75):

"Norman LeBlane" should be changed to --Norman LeBlanc--

"Corey M. Talbel" should be changed to --Corey M. Talbot--

Signed and Sealed this
Third Day of July, 2012

David J. Kappos

David J. Kappos
*Director of the United States Patent and Trademark Office*